US010004284B2

(12) United States Patent
Spenser et al.

(10) Patent No.: US 10,004,284 B2
(45) Date of Patent: Jun. 26, 2018

(54) AQUATIC SPORT PERFORMANCE GARMENT WITH ARMS-UP CONSTRUCTION AND METHOD OF MAKING SAME

(71) Applicant: ROKA Sports, Inc., Dallas, TX (US)

(72) Inventors: Kurt R. Spenser, Dallas, TX (US); Robert A. Canales, Dallas, TX (US); Mark C. Stephens, Dallas, TX (US); Nathan Tracy, Dallas, TX (US)

(73) Assignee: ROKA SPORTS, INC., Dallas, TX (US)

( * ) Notice: Subject to any disclaimer, the term of this patent is extended or adjusted under 35 U.S.C. 154(b) by 0 days. days.

(21) Appl. No.: 15/791,754

(22) Filed: Oct. 24, 2017

(65) Prior Publication Data

US 2018/0064183 A1 Mar. 8, 2018

Related U.S. Application Data

(63) Continuation of application No. 15/471,895, filed on Mar. 28, 2017, now Pat. No. 9,888,731.

(Continued)

(51) Int. Cl.

*A41D 13/012* (2006.01)
*A41D 31/02* (2006.01)

(Continued)

(52) U.S. Cl.

CPC ..... *A41D 13/012* (2013.01); *A41D 7/00* (2013.01); *A41D 31/02* (2013.01);

(Continued)

(58) Field of Classification Search

CPC ..... A41D 13/012; A41D 27/10; A41D 7/00; A41D 2400/00; A41D 2400/24;

(Continued)

(56) References Cited

U.S. PATENT DOCUMENTS 1,731,695 A 10/1929 Wright
2,462,361 A 2/1949 Cassens (Continued)

FOREIGN PATENT DOCUMENTS

FR 2566320 A1 12/1985
GB 2259237 A 3/1993

(Continued)

OTHER PUBLICATIONS

2012 Bluseventy "full sleeve" Reaction wetsuit. http://www.superiormantri.com/shop. (4 pages) (Nov. 20, 2012).

(Continued)

*Primary Examiner* — Amy Vanatta

(74) *Attorney, Agent, or Firm* — Wilson, Sonsini, Goodrich & Rosati

(57) ABSTRACT

An aquatic sport performance garment configured to improve a user's performance, enhance a user's speed and ease with which the wearer moves through water, provide better control of body temperature in diverse environments and reduce overall fatigue while wearing the garment. A garment having an upper-torso portion, a free-floating, sealing collar and sleeves biased in an arms-up configuration.

20 Claims, 7 Drawing Sheets

Related U.S. Application Data

(60) Provisional application No. 62/315,378, filed on Mar. 30, 2016.

(51) Int. Cl.
*A41D 7/00* (2006.01)
*B63C 11/04* (2006.01)

(52) U.S. Cl.
CPC ..... *A41D 2500/52* (2013.01); *A41D 2600/10* (2013.01); *B63C 2011/046* (2013.01)

(58) Field of Classification Search
CPC ..... A41D 2300/22; A41D 2600/10; A41D 2500/52; A41D 27/18; A41D 27/02; A41D 31/02; A41D 31/00; A41D 31/0011; A41D 31/0016; B63C 9/087; B63C 9/11; B63C 11/04; B63C 2011/046; B63C 9/093; B63C 9/115; B63C 2011/043
USPC ..... 2/2.15, 2.16, 2.17, 125, 67; D2/732
See application file for complete search history.

(56) References Cited

U.S. PATENT DOCUMENTS 2,981,954 A * 5/1961 Garbellano ..... B63C 11/04 2/2.17
3,134,994 A 6/1964 Christofferson
D199,514 S * 11/1964 O'Neill ..... D2/732
3,771,169 A 11/1973 Edmund
4,293,957 A 10/1981 Melarvie
4,397,636 A 8/1983 Ganshaw
4,451,934 A 6/1984 Gioello
4,473,908 A 10/1984 Knecht
4,698,847 A 10/1987 Yoshihara
4,809,364 A * 3/1989 Lent ..... A41D 13/012 2/2.15
4,862,517 A * 9/1989 Meistrell ..... B63C 11/04 2/2.17
4,946,453 A * 8/1990 Monson ..... A41D 13/0017 2/2.15
4,999,845 A 3/1991 Jenks, Jr. et al.
5,013,271 A 5/1991 Bartlett
5,022,878 A 6/1991 Casad
5,052,053 A 10/1991 Peart et al.
5,165,110 A * 11/1992 Grilliot ..... A41D 13/00 2/125
5,191,658 A 3/1993 Meistrell
5,410,759 A 5/1995 Hari
5,509,142 A * 4/1996 Connell ..... A41D 13/02 2/79
5,630,229 A 5/1997 Machado et al.
5,768,703 A 6/1998 Machado et al.
5,809,567 A 9/1998 Jacobs et al.
5,898,934 A 5/1999 Hunter et al.
5,940,884 A * 8/1999 Grilliot ..... A62B 17/003 2/125
5,953,750 A 9/1999 Stella
6,202,216 B1 * 3/2001 Watanabe ..... A41D 1/04 2/125
7,017,195 B2 3/2006 Buckman et al.
7,037,155 B2 5/2006 Freeman et al.
7,059,925 B2 6/2006 Smith et al.
7,125,302 B2 10/2006 Haselsteiner
7,150,667 B1 12/2006 Leung
7,233,829 B2 6/2007 Vlad
7,460,886 B2 12/2008 Mazzarolo
7,464,414 B2 12/2008 McDuff
D608,077 S 1/2010 Bybee et al.
7,992,218 B2 8/2011 O'Hara
8,032,944 B2 10/2011 Demetropoulos
9,572,378 B2 2/2017 Canales et al.
9,661,881 B2 5/2017 Canales et al.
D800,995 S * 10/2017 Gatto ..... D2/720
2001/0014981 A1 8/2001 Fairhurst et al.
2002/0026664 A1 3/2002 Grounds et al.
2003/0233694 A1 12/2003 Wescombe-Down
2005/0101203 A1 5/2005 Kemp et al.
2005/0241044 A1 * 11/2005 Zorica ..... A41D 27/10 2/69
2006/0073749 A1 4/2006 Turner
2006/0085889 A1 4/2006 Okajima
2006/0230490 A1 10/2006 Okajima
2006/0260018 A1 11/2006 Gordon et al.
2007/0000015 A1 1/2007 Alaniz et al.
2007/0028351 A1 * 2/2007 Coolik ..... A41D 27/10 2/115
2007/0077126 A1 4/2007 Garcia et al.
2007/0277278 A1 12/2007 O'Brien
2007/0294797 A1 12/2007 Furgerson et al.
2008/0141430 A1 6/2008 Rance et al.
2009/0004938 A1 1/2009 Staver et al.
2009/0038047 A1 2/2009 Di
2009/0260125 A1 10/2009 Grilliot et al.
2010/0212057 A1 8/2010 Sullivan
2010/0225758 A1 9/2010 Mashiah
2010/0269238 A1 10/2010 O'Hara
2010/0299799 A1 * 12/2010 Belluye ..... A41D 13/0015 2/69
2011/0035859 A1 * 2/2011 Koga ..... A41D 13/0015 2/69
2011/0055746 A1 3/2011 Mantovani et al.
2011/0151733 A1 6/2011 Gadler
2011/0266314 A1 11/2011 Sommers
2012/0011635 A1 * 1/2012 Tsuji ..... A41D 1/04 2/69
2012/0128425 A1 5/2012 Walck
2012/0144541 A1 6/2012 Mitchell et al.
2013/0042377 A1 2/2013 Moore et al.
2013/0219579 A1 8/2013 Molyneux et al.
2014/0313037 A1 10/2014 Canales et al.
2014/0338089 A1 * 11/2014 Brooks ..... A41D 13/0015 2/2.15
2015/0082510 A1 3/2015 Inzer
2015/0196072 A1 * 7/2015 Inzer ..... A41D 13/0002 2/69
2016/0262460 A1 9/2016 Inzer
2017/0049159 A1 2/2017 Canales et al.
2017/0079339 A1 3/2017 Yeomans et al.
2017/0215492 A1 8/2017 Canales et al.
2017/0280791 A1 10/2017 Spenser et al.
2017/0280792 A1 10/2017 Spenser et al.

FOREIGN PATENT DOCUMENTS

GB 2529472 A 2/2016
JP 2005263116 A 9/2005
WO WO-9959437 A1 11/1999
WO WO-2007038794 A2 4/2007
WO WO-2013082173 A1 6/2013

OTHER PUBLICATIONS

BarracudaUSA C1 Womens Comp Wetsuit. www.skylinenw.com. (2 pages) (Nov. 20, 2012).
Blue Seventy Axis Sleeveless Women's New Triathlon Wetsuit. www.wetsuitrental.com (2 pages) (Nov. 20, 2012).
Blue Seventy Wetsuits. www.intelligent-triathlon-training.com/blue-seventy.html. (3 pages) (Nov. 20, 2012).
Co-pending U.S. Appl. No. 15/790,637, filed Oct. 23, 2017.
Co-pending U.S. Appl. No. 15/790,706, filed Oct. 23, 2017.
Demerly. 2XU V:2 Wetsuit—A Collection of Valid Features. TriSports.com (9 pages) (Nov. 20, 2012).
PCT/US2012/066879 International Preliminary Report on Patentability dated Jun. 3, 2014.
PCT/US2012/066879 International Search Report dated Mar. 26, 2013.
Quintana Roo Neoprene Speed Sleeves. www.wetsuitrental.comlquintana-roo-speed- sleeve.html. (1 page) (Nov. 12, 2011).

(56) References Cited

OTHER PUBLICATIONS

Sammamish Valley Cycle. Triathlon Gear. (4 pages) (Nov. 20, 2012).
Slowtwitch.com. Product 2007. 2XU. (4 pages) (Nov. 20, 2012).
T:3 Team Wetsuit. www.2xu.com/product/731/T3-Team-Wetsuit./90. (2 pages) (Nov. 20, 2012).
U.S. Appl. No. 14/361,296 Office Action dated Sep. 1, 2016.
U.S. Appl. No. 15/346,654 Office Action dated Jan. 19, 2017.
U.S. Appl. No. 15/469,191 Office Action dated Jun. 1, 2017.
U.S. Appl. No. 15/471,895 First Action Interview dated Jul. 11, 2017.
U.S. Appl. No. 15/471,895 First Action Interview dated Jun. 2, 2017.
U.S. Appl. No. 15/484,707 First Action Interview dated Jun. 8, 2017.
Wetsuit Wearhouse. blueseventy. Men's Blue Seventy SPRINT Triathlon Wetsuit. (4 pages) (Nov. 20, 2012).
U.S. Appl. No. 15/790,637 Office Action dated Jan. 23, 2018.
U.S. Appl. No. 15/790,706 Office Action dated Jan. 30, 2018.
Definition of Buoyancy. The Physics Hypertextbook. Https://physics.info/buoyancy/summary.shtml (last referenced Feb. 27, 2018) (2 pgs).
Keeley. Open Cell vs. Closed Cell Foam: What's the Difference? CGR Products. Https://www.cgrproducts.com/open-cell-vs-closed-cell-foam (last accessed Feb. 27, 2018) (9 pgs).

* cited by examiner

AQUATIC SPORT PERFORMANCE GARMENT WITH ARMS-UP CONSTRUCTION AND METHOD OF MAKING SAME

CROSS-REFERENCE

This application is a continuation of U.S. patent application Ser. No. 15/471,895, entitled "Aquatic Sport Performance Garment with Arms-Up Construction and Method of Making Same" filed Mar. 28, 2017, which claims the benefit of U.S. Provisional Application No. 62/315,378, filed Mar. 30, 2016, which applications are incorporated herein by reference.

BACKGROUND OF THE INVENTION

The present disclosure relates generally to swimming apparel, and more particularly to the design and construction of aquatic sports performance apparel, cold water wetsuits, deep water scuba wetsuits, triathlon garments, surfing apparel, aquatic compression garments and other swimwear. Various aquatic sport performance apparel have been developed in the art, and are utilized for a variety of purposes. Among these are performance wetsuits, which are popular among triathletes and open water swimmers. Additionally, special performance wetsuits have been adopted by surfers, scuba divers and the military for Special Forces personnel. Performance wetsuits provide drag reduction in the form of faster-than-skin surface coatings, warmth and additional buoyancy to the wearer, and are designed to enhance the speed and ease with which the wearer moves through the water while swimming.

SUMMARY OF THE INVENTION

Provided herein is an aquatic sports performance garment configured to improve a user's performance, enhance a user's speed and ease with which the wearer moves through water, provide better control of body temperature in diverse environments and reduce overall fatigue while wearing the garment.

Provided herein is an aquatic sport performance garment configured to reduce fatigue of a user when the garment is worn, the garment having an aquatic sports performance garment material, the garment comprising: an upper torso portion comprising; a left sleeve portion having a left shoulder region, a left armpit region and a left sleeve outer edge; and a right sleeve portion having an right shoulder region, a right armpit region and a right sleeve outer edge; wherein the left sleeve portion of the garment is biased in an arms-up configuration, such that the left sleeve outer edge extends out generally anteriorly from a coronal plane of the garment at an angular range from about −15.0° to at least about +100.0° relative to a second transverse plane transecting the upper torso at or about a top of the left shoulder region and a top of the right shoulder region, and wherein the left sleeve portion of the garment is further positioned approximately parallel to a sagittal plane of the garment, when the garment material is at rest, prior to being worn by the user, wherein the right sleeve portion of the garment is biased in an arms-up configuration, such that the right sleeve outer edge extends out generally anteriorly from the coronal plane of the garment at an angular range from about −15.0° to at least about +100.0° relative to the second transverse plane, and wherein the right sleeve portion of the garment is further positioned approximately parallel to the sagittal plane of the garment, when the garment material is at rest, prior to being worn by the user.

Provided herein is an aquatic sports performance garment configured to reduce fatigue of a user when the garment is worn, the garment having an aquatic sports performance garment material, the garment comprising: an upper torso portion comprising; a left sleeve portion having a left shoulder region, a left armpit region and a left sleeve outer edge; and a right sleeve portion having an right shoulder region, a right armpit region and a right sleeve outer edge; wherein the left sleeve portion of the garment is biased in an arms-up configuration, such that the left sleeve outer edge extends out generally laterally relative to a sagittal plane of the garment from a left lateral aspect of the garment at an angular range from about −15.0° to at least about +100.0° relative to a second transverse plane transecting the upper torso at or about a top of the left shoulder region and a top of the right shoulder region, and wherein the left sleeve portion of the garment is further positioned in a range that is approximately parallel to, or anterior to, a coronal plane of the garment, when the garment material is at rest, prior to being worn by the user, wherein the right sleeve portion of the garment is biased in an arms-up configuration, such that the right sleeve outer edge extends out generally laterally relative to the sagittal plane from a right lateral aspect of the garment at an angular range from about −15.0° to at least about +100.0° relative to the second transverse plane, and wherein the right sleeve portion of the garment is further positioned in a range that is approximately parallel to, or anterior to, a coronal plane of the garment, when the garment material is at rest, prior to being worn by the user.

In any embodiment of the aquatic sports performance garment, the garment material in the left shoulder region, left armpit region, right armpit region and right armpit region comprises a material thickness from about 0.5 mm to about 2.5 mm. In any embodiment of the aquatic sports performance garment, the garment material in the left shoulder region, left armpit region, right armpit region and right armpit region comprises a modulus of elasticity from 0.31 $kg/cm^2$ at 50% elongation to 4.14 $kg/cm^2$ at 300% elongation. In any embodiment of the aquatic sports performance garment, the upper torso portion further comprises: a neck region; a chest (pectoralis) region; an upper back (trapezius) region; an upper (latissimus dorsi) region, an abdominal region; a lateral oblique (oblique abdominal) region; and a mid-to-low back (thoraco-lumbar) region. In any embodiment of the aquatic sports performance garment described herein, the neck region comprises a large collar portion; and a free-floating flexible collar with a neck opening; wherein the large collar portion is patterned and configured to improve flexibility in the left shoulder region, left armpit region, right shoulder region and right armpit region; and wherein the free-floating flexible collar comprises highly flexible garment material configured to seal around a neck of the user to reduce or prevent water from entering the garment around the neck. In any embodiment of the aquatic sports performance garment described herein, the neck region, chest (pectoralis) region, and upper back (trapezius) region further comprise a material thickness from about 1.0 mm to about 7.0 mm.

In some embodiments of the aquatic sports performance garment described herein, the neck region, chest (pectoralis) region, and upper back (trapezius) region further comprise a material thickness from about 1.0 mm to about 2.5 mm. In any embodiment of the aquatic sports performance garment, the free-floating flexible collar, the abdominal region, the lateral oblique (oblique abdominal) region or the mid-to-low back (thoraco-lumbar) region further comprise a material thickness from about 1.0 mm to about 7.0 mm. In some embodiments of the aquatic sports performance garment, the free-floating flexible collar, the abdominal region, the lateral oblique (oblique abdominal) region or the mid-to-low back (thoraco-lumbar) region further comprise a material thickness from about 1.0 mm to about 3.0 mm. In any embodiment of the aquatic sports performance garment, the garment material of the upper back (trapezius) region; the upper (latissimus dorsi) region, the chest (pectoralis) region; the abdominal region; or the mid-to-low back (thoraco-lumbar) region comprises an embedded liner that inhibits elongation of the garment material therein more than the garment material in the left shoulder region, the left armpit region, the right shoulder region or the right armpit region. In any embodiment of the aquatic sports performance garment, the left sleeve portion and the right sleeve portion comprise: short sleeves terminating between an elbow and a biceps region; or long sleeves terminating between an elbow and a wrist. In any embodiment of the aquatic sports performance garment, the neck region further comprises: a large collar portion; and a free-floating flexible collar with a neck opening; wherein the large collar portion is patterned and configured to improve flexibility in the left shoulder region, left armpit region, right shoulder region and right armpit region; and wherein the free-floating flexible collar comprises highly flexible garment material configured to seal around a neck of the user to reduce or prevent water from entering the garment through the neck opening. In any embodiment of the aquatic sports performance garment, the garment material of the left shoulder region, the left armpit region, the right shoulder region, the right armpit region comprises multi-directional elasticity comprising elongation having a range from: about 50% to about 400%; about 100% to about 350%; about 100% to about 300%; about 100% to about 250%; about 100% to about 200%; or about 100% to about 150%. In some embodiments of the aquatic sports performance garment, the aquatic sports performance garment further comprises: a lower torso portion having an aquatic sports performance garment material, the lower torso portion comprising; a waist region, a pelvic girdle region, including a crotch region; and a left leg portion and a right leg portion below the crotch region. In some embodiments of the aquatic sports performance garment, the left leg portion and the right leg portion comprise: a short leg portion terminating at or above a knee; or a long leg portion extending below the knee. In any embodiment of the aquatic sports performance garment, the left sleeve portion and the right sleeve portion have material thicknesses in a range comprising: about 0.5 mm to about 7.0 mm; about 1.0 mm to about 6.0 mm; about 1.0 mm to about 5.0 mm; about 1.0 mm to about 4.0 mm; about 1.0 mm to about 3.0 mm; about 1.0 mm to about 2.0 mm; about 0.5 mm to about 2.0 mm; about 0.5 mm to about 1.5 mm; about 1.0 mm to about 1.5 mm. or about 0.5 mm to about 1.0 mm. In any embodiment of the aquatic sports performance garment, the material for constructing the upper back (trapezius) region comprises multi-directional elasticity comprising elongation having a range from: about 50% to about 400%; about 100% to about 350%; about 100% to about 300%; about 100% to about 250%; about 100% to about 200%; or about 100% to about 150%. In any embodiment of the aquatic sports performance garment, the material for constructing the upper (latissimus dorsi) region, the chest (pectoralis) region, the abdominal region, the lateral oblique region or the mid-to-low back (thoraco-lumbar) region comprises uni-directional elasticity comprising elongation having a range from: about 50% to about 400%; about 100% to about 350%; about 100% to about 300%; about 100% to about 250%; about 100% to about 200%; or about 100% to about 150%. In any embodiment of the aquatic sports performance garment, the material for constructing the upper (latissimus dorsi) region, the chest (pectoralis) region, the abdominal region, the lateral oblique region or the mid-to-low back (thoraco-lumbar) region comprises multi-directional elasticity comprising elongation having a range from: about 50% to about 400%; about 100% to about 350%; about 100% to about 300%; about 100% to about 250%; about 100% to about 200%; or about 100% to about 150%.

In any embodiment of the aquatic sports performance garment, the material comprises neoprene. Further still, in any embodiment of the aquatic sports performance garment, the material comprises a rubber; a nylon; a polyester; a polypropylene; Lycra®, or Spandex®.

In some embodiments, the aquatic sports performance garment further comprises a quick opening feature. In some embodiments of the aquatic sports performance garment, the quick opening feature is positioned: on an anterior aspect of the garment; on a lateral aspect of the garment; or on a posterior aspect of the garment. In some embodiments of the aquatic sports performance garment, the quick opening feature is a zipper. In some embodiments of the aquatic sports performance garment, the quick opening feature comprises a Velcro® attachment. In some embodiments of the aquatic sports performance garment, the quick opening feature comprises: a hook; a loop; a rail, or a lip. In any embodiment of the aquatic sports performance garment, the material comprises a liner. In some embodiments, the liner comprises nylon. In any one of the embodiments the liner provides uni-lateral elongation properties or multi-lateral elongation properties to the garment materials. In any embodiment of the aquatic sports performance garment, the aquatic sports performance garment material comprises a configurable embedded liner that limits the percentage and direction of elongation of the garment material, wherein the percentage of elongation of the garment materials is from at least 50% at least 400%, and wherein the direction of elongation of the garment materials is either uni-direction or multi-directional.

Provided herein is a method of manufacturing an aquatic sports performance garment comprising: providing an aquatic sports performance material; patterning an upper torso portion comprising; a neck region; a chest (pectoralis) region; an upper back (trapezius) region; an upper (latissimus dorsi) region, an abdominal region; a lateral oblique (oblique abdominal) region; and a mid-to-low back (thoraco-lumbar) region; wherein the neck region comprises a large collar portion; and a free-floating flexible collar with a neck opening; patterning a left sleeve portion having a left shoulder region, a left armpit region and a left sleeve outer edge; patterning a right sleeve portion having a right shoulder region, a right armpit region, and a right sleeve outer edge; wherein the left sleeve portion of the garment is biased in an arms-up configuration, such that the left sleeve outer edge extends out generally anteriorly from a coronal plane of the garment at an angular range from about −15.0° to at least about +100.0° relative to a second transverse plane transecting the upper torso at or about a top of the left shoulder region and a top of the right shoulder region, and wherein the left sleeve portion of the garment is further positioned approximately parallel to a sagittal plane of the garment, when the garment material is at rest, prior to being worn by a user, and wherein the right sleeve portion of the garment is biased in an arms-up configuration, such that the right sleeve outer edge extends out generally anteriorly from the coronal plane of the garment at an angular range from about −15.0° to at least about +100.0° relative to the second transverse plane, and wherein the right sleeve portion of the garment is further positioned approximately parallel to the sagittal plane of the garment, when the garment material is at rest, prior to being worn by the user, and wherein the upper-torso portion of the garment covers the upper-torso of the user from a first transverse plane at or about a waist of the user.

Provided herein is a method of manufacturing an aquatic sports performance garment comprising: providing an aquatic sports performance material; patterning an upper torso portion comprising; a neck region with a neck opening; a chest (pectoralis) region; an upper back (trapezius) region; an upper (latissimus dorsi) region, an abdominal region; a lateral oblique (oblique abdominal) region; and a mid-to-low back (thoraco-lumbar) region; wherein the neck opening comprises the free-floating flexible collar, patterning a left sleeve portion having a left shoulder region, a left armpit region and a left sleeve outer edge; patterning a right sleeve portion having a right shoulder region, a right armpit region, and a right sleeve outer edge; wherein the left sleeve portion of the garment is biased in an arms-up configuration, such that the left sleeve outer edge extends out generally laterally relative to a sagittal plane of the garment from a left lateral aspect of the garment at an angular range from about −15.0° to at least about +100.0° relative to a second transverse plane transecting the upper torso at or about a top of the left shoulder region and a top of the right shoulder region, and wherein the left sleeve portion of the garment is further positioned in a range that is approximately parallel to, or anterior to, a coronal plane of the garment, when the garment material is at rest, prior to being worn by the user, and wherein the right sleeve portion of the garment is biased in an arms-up configuration, such that the right sleeve outer edge extends out generally laterally relative to the sagittal plane from a right lateral aspect of the garment at an angular range from about −15.0° to at least about +100.0° relative to the second transverse plane, and wherein the right sleeve portion of the garment is further positioned in a range that is approximately parallel to, or anterior to, a coronal plane of the garment, when the garment material is at rest, prior to being worn by the user. In some embodiments the method further comprises: patterning a quick opening feature in the upper-torso portion; wherein the quick opening feature is positioned: on an anterior aspect of the garment; on a lateral aspect of the garment; or on a posterior aspect of the garment. In some embodiments of the method, the quick opening feature is a zipper. In some embodiments of the method, the quick opening feature comprises a Velcro® attachment. In some embodiments of the method, the quick opening feature comprises: a hook; a loop; a rail, or a lip. In some embodiments the method further comprises: patterning a lower torso portion, abuttable to, or affixable to, the upper torso portion comprising; a waist region, a pelvic girdle region, a crotch region, a left leg portion and a right leg portion; wherein the lower torso portion covers the lower torso of the user from a first transverse plane at or below the waist of the user. In some embodiments the method further comprises: affixing the lower torso portion to the upper torso portion to form a one-piece aquatic sports performance garment. In some embodiments of the method, the left sleeve portion and the right sleeve portion comprise: patterning a short sleeve terminating between an elbow region and a biceps region; or patterning a long sleeve terminating between an elbow region and a wrist. In some embodiments of the method, the left leg portion and the right leg portion comprise: a short leg portion terminating at or above a knee; or a long leg portion extending below the knee. In some embodiments the method further comprises: providing a thermally insulating material having a thickness in a range from about 0.5 mm to about 7.0 mm. In some embodiments of the method, the thermally insulating material comprises: a neoprene; a rubber; nylon; a polyester; a polypropylene; Lycra®; or Spandex®. In some embodiments the method further comprises: providing the material with multi-directional elasticity in the left shoulder region, the left armpit region, the right shoulder region, the right armpit region and the upper back (trapezius) region; and providing material with uni-directional elasticity; in the upper lateral (latissimus dorsi) region, in the chest (pectoralis) region, in the abdominal region, in the lateral oblique region, and in the mid-to-low back (thoraco-lumbar) region.

Provided herein is a wetsuit comprising: a material providing thermal insulation to a user thereof, an upper torso portion comprising a neck region with an opening; and a left sleeve portion having an upper left shoulder region, a left armpit region and a left sleeve outer edge; and a right sleeve portion having an upper right shoulder region, a right armpit region and a right sleeve outer edge; wherein the left sleeve portion of the garment is biased in an arms-up configuration, such that the left sleeve outer edge extends out generally anteriorly from a coronal plane of the garment at an angular range from about −15.0° to at least about +100.0° relative to a second transverse plane transecting the upper torso at or about a top of the left shoulder region and a top of the right shoulder region, and wherein the left sleeve portion of the garment is further positioned approximately parallel to a sagittal plane of the garment, when the garment material is at rest, prior to being worn by the user, wherein the right sleeve portion of the garment is biased in an arms-up configuration, such that the right sleeve outer edge extends out generally anteriorly from the coronal plane of the garment at an angular range from about −15.0° to at least about +100.0° relative to the second transverse plane, and wherein the right sleeve portion of the garment is further positioned approximately parallel to the sagittal plane of the garment, when the garment material is at rest, prior to being worn by the user, wherein the left sleeve portion and the right sleeve portion comprise; short sleeves terminating between an elbow and a biceps region; or long sleeves terminating between an elbow and a wrist, a lower torso portion having an aquatic sports performance garment material, the lower torso portion comprising; a waist region, a pelvic girdle region, including a crotch region; and a left leg portion and a right leg portion below the crotch region; wherein the left leg portion and the right leg portion comprise; a short leg portion terminating at or above a knee; or a long leg portion extending below the knee.

Provided herein is a wetsuit comprising: a material providing thermal insulation to a user thereof; an upper torso portion comprising; a left sleeve portion having an upper left shoulder region, a left armpit region and a left sleeve outer edge; and a right sleeve portion having an upper right shoulder region, a right armpit region and a right sleeve outer edge; wherein the left sleeve portion of the garment is biased in an arms-up configuration, such that the left sleeve outer edge extends out generally laterally relative to a sagittal plane of the garment from a left lateral aspect of the garment at an angular range from about −15.0° to at least about +100.0° relative to a second transverse plane transecting the upper torso at or about a top of the left shoulder region and a top of the right shoulder region, and wherein the left sleeve portion of the garment is further positioned in a range that is approximately parallel to, or anterior to, a coronal plane of the garment, when the garment material is at rest, prior to being worn by the user, wherein the right sleeve portion of the garment is biased in an arms-up configuration, such that the right sleeve outer edge extends out generally laterally relative to the sagittal plane from a right lateral aspect of the garment at an angular range from about −15.0° to at least about +100.0° relative to the second transverse plane, and wherein the right sleeve portion of the garment is further positioned in a range that is approximately parallel to, or anterior to, a coronal plane of the garment, when the garment material is at rest, prior to being worn by the user, wherein the left sleeve portion and the right sleeve portion comprise; short sleeves terminating between an elbow and a biceps region; or long sleeves terminating between an elbow and a wrist, a lower torso portion having an aquatic sports performance garment material, the lower torso portion comprising; a waist region, a pelvic girdle region, including a crotch region; and a left leg portion and a right leg portion below the crotch region; wherein the left leg portion and the right leg portion comprise; a short leg portion terminating at or above a knee; or a long leg portion extending below the knee. In any one of the wetsuit configurations described herein, the wetsuit further comprises a neck region; a chest (pectoralis) region; an upper back (trapezius) region; an upper (latissimus dorsi) region, an abdominal region; a lateral oblique (oblique abdominal) region; and a mid-to-low back (thoraco-lumbar) region. In any one of the wetsuit configurations described herein, the garment material in the left shoulder region, left armpit region, right armpit region and right armpit region comprise a material thickness from about 0.5 mm to about 7.0 mm. In some embodiments of the wetsuit configurations described herein, the garment material in the left shoulder region, left armpit region, right armpit region and right armpit region comprise a material thickness from about 0.5 mm to about 2.5 mm. In any one of the wetsuit configurations described herein, the neck region, chest (pectoralis) region, and upper back (trapezius) region further comprise a material thickness from about 1.0 mm to about 7.0 mm. In some embodiments of the wetsuit configurations described herein, the neck region, the chest (pectoralis) region, or the upper back (trapezius) region further comprise a material thickness from about 1.0 mm to about 2.5 mm. In any one of the wetsuit configurations described herein, the free-floating flexible collar, the abdominal region, the lateral oblique (oblique abdominal) region or the mid-to-low back (thoraco-lumbar) region further comprise a material thickness from about 1.0 mm to about 7.0 mm. In some embodiments of the wetsuit configurations described herein, the free-floating flexible collar, the abdominal region, the lateral oblique (oblique abdominal) region or the mid-to-low back (thoraco-lumbar) region further comprise a material thickness from about 1.0 mm to about 3.0 mm. In any one of the wetsuit configurations described herein, the garment material in the left shoulder region, left armpit region, right armpit region and right armpit region comprise a modulus of elasticity from 0.31 kg/cm$^2$ at 50% elongation to 4.14 kg/cm$^2$ at 300% elongation.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
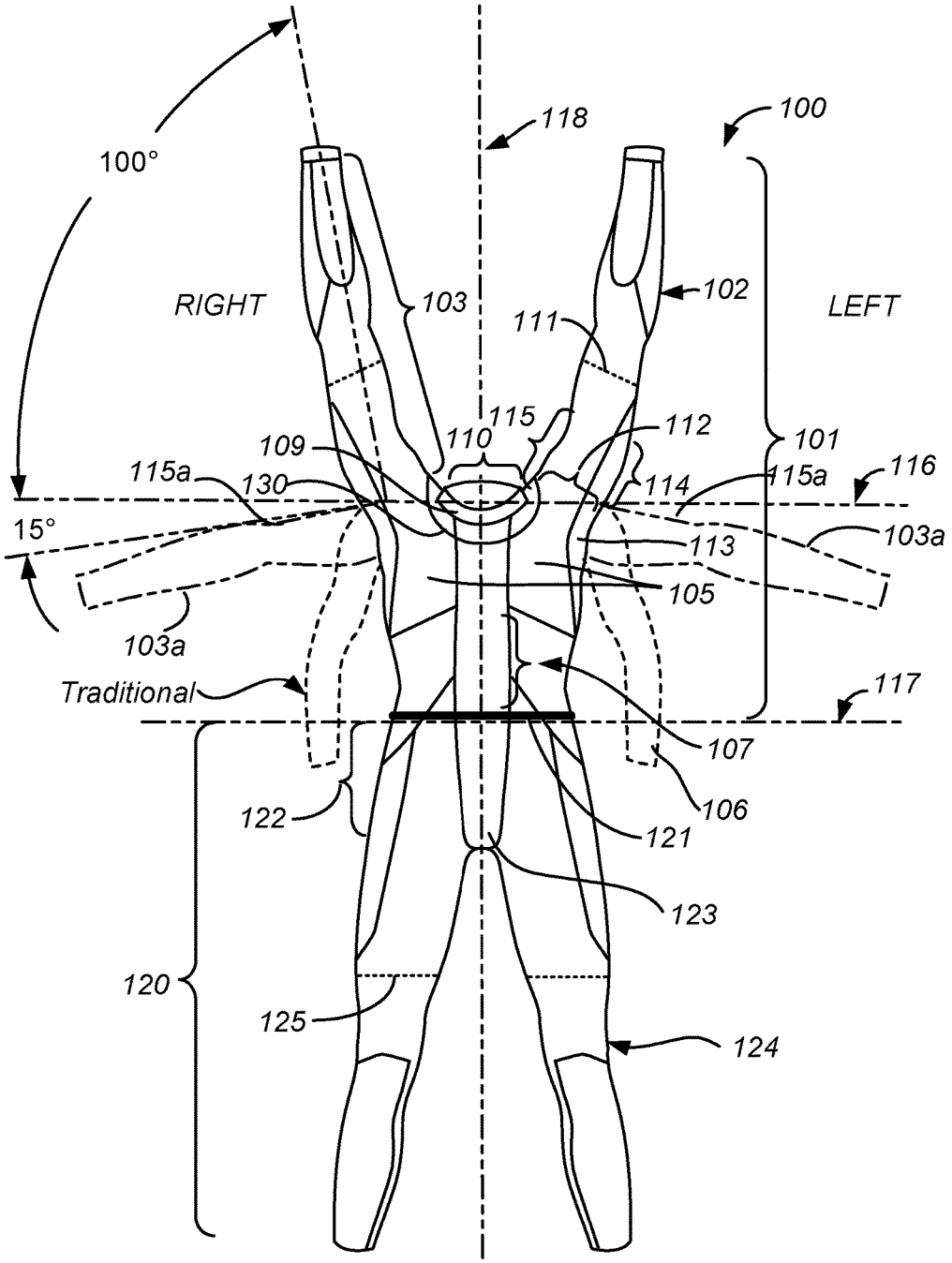
FIG. 1 is a front view of an illustrative embodiment of a sports performance garment illustrating representative multiple possible positions of the arms in an "arms-up" at-rest lateral or anterior lateral and overhead position in comparison to a traditional "arms-down" lateral position, in accordance with the teachings herein.

While existing aquatic sport performance apparel are generally suitable for their intended purpose, further improvements in the art are possible. This is especially true with respect to performance garments that are designed for use in swimming and triathlon events, since even small improvements in such a sports performance garment or wetsuit can make the difference between success and failure for the wearer. Additionally, aquatic sports performance apparel for extreme sports such as cold water swimming, deep water scuba, triathlons, and surfing need to provide performance characteristics that give the user every advantage possible to increase their performance and safety.

The present disclosure relates generally to swimming apparel, and more particularly to the design and construction of aquatic sports performance apparel, cold water wetsuits, deep water scuba wetsuits, triathlon garments, surfing apparel, aquatic compression garments and other performance swimwear. Various aquatic sport performance apparel have been developed in the art, and are utilized for a variety of purposes. Among these are performance wetsuits, which are popular among triathletes and open water swimmers. Additionally, special performance wetsuits have been adopted by surfers, scuba divers and the military for Special Forces personnel. Performance wetsuits provide drag reduction in the form of faster-than-skin surface coatings, warmth and additional buoyancy to the wearer, and are designed to enhance the speed and ease with which the wearer moves through the water and reduce fatigue during use.

Provided herein is an aquatic sports performance garment configured to improve a user's performance, enhance a user's speed and ease with which the wearer moves through water, provide better control of body temperature in diverse environments and reduce overall fatigue while wearing the garment.

Other wetsuits are too thick in some areas and subsequently too stiff, resulting in the overheating and general strain of various muscle groups, causing premature fatigue. Alternatively, some wetsuits are not stiff enough in other areas, resulting in failure to properly support skeletal structures or appropriately activate core muscle groups necessary to provide the extra lift a swimmer needs to improve buoyancy, improve net body position in the water, promote proper swimming mechanics, or encourage optimal rotation of the body along the longitudinal axis, all of which can affect the user's endurance.

Still other wetsuits incorporate lower density neoprene in a bid to improve buoyancy. However, the density distribution in such wetsuits is typically also sub-optimal, leading to increased heat retention and resistance to proper swimming mechanics. For example, such designs often incorporate lower density materials in the arms and hip regions of the wetsuit, which may inhibit proper rotation of the swimmer's body along its longitudinal axis (roll). Similarly, such designs also often fail to ensure optimal body position along a lateral axis (pitch).

Further still, the patterning of the components of the garment can play a critical role in reducing the fatigue of a user, by reducing the amount of energy required to continuously overcome the inherent elasticity of the material and the way the components of the garment are assembled.

It has now been found that many of the foregoing issues are addressable through modified construction of a wetsuit.

It is understood by one skilled in the art that materials and material conditions may be altered or manipulated to provide varying desirable characteristics, or conversely, to eliminate undesirable characteristics. These characteristics or material properties can include, but are not limited to, thickness, direction of stretch, elasticity, modulus of elasticity, creep, fatigue, flexural strength, rotational strength and/or tensile strength depending on the homogeneity of the material, bending modulus, resilience, shear strength, stiffness and toughness, among other physical and/or chemical properties.

As used herein, the term "lateral" refers to the anatomic sides of a body, or wetsuit: In anatomy, the side of the body or a body part that is farther from the middle or center of the body. Typically, lateral refers to the outer side of the body, but it is also used to refer to the side of a garment. By inference, there are two "lateral" sides to a body, aquatic sports performance garment, or wetsuit.

As used herein, the term "anterior" generally refers to human anatomy and means the front surface of the body (or a garment worn on a body); often used to indicate the position of one structure relative to another, that is, situated nearer the front part of the body. Alternately, it may also refer in a similar fashion to an apparatus or structure.

As used herein, the term "posterior" generally refers to human anatomy and means the back surface of the body (or a garment worn on a body); often used to indicate the position of one structure relative to another, that is, situated nearer the back part of the body. Alternately, it may also refer in a similar fashion to an apparatus or structure.

As used herein, and unless otherwise specified, the term "superior" generally refers to human anatomy and means situated nearer the vertex of the head in relation to a specific reference point; opposite of inferior. It may also mean situated above or directed upward. Alternately, it may also refer in a similar fashion to an apparatus, (or a garment worn on a body) or structure.

As used herein, and unless otherwise specified, the term "inferior" generally refers to human anatomy and means situated nearer the soles of the feet in relation to a specific reference point; opposite of superior. It may also mean situated below or directed downward. Alternately, it may also refer in a similar fashion to an apparatus, (or a garment worn on a body) or structure.

As used herein, and unless otherwise specified, the term "medial" generally refers to orientations of human anatomy (or a garment worn on a body) and means denoting a position situated toward the median plane or midline of the body. Alternately, it may also refer in a similar fashion to an apparatus or structure.

As used herein, and unless otherwise specified, the term "transverse plane", (also called the horizontal plane, axial plane, or transaxial plane) is an imaginary plane that divides the body into superior and inferior parts at the waist and or shoulders and is perpendicular to the coronal and sagittal planes. As used herein the two transverse planes described are typically: a first transverse plane at the waist or approximate center of gravity of a body; and a second transverse plane at the shoulders separating the head from the rest of the body.

As used herein, and unless otherwise specified, the term "coronal plane", (also known as the frontal plane, sometimes referred to as a longitudinal plane because it is perpendicular to the transverse plane) is any vertical plane that divides the body into ventral and dorsal (belly and back) sections.

As used herein, and unless otherwise specified, the term "sagittal plane", (also known as median plane or mid-sagittal plane) is an anatomical plane which divides the body into right and left halves. This plane cuts the body into halves (assuming bilateral symmetry), passing through midline structures such as the navel and spine. The term parasagittal is used to describe any plane parallel to the sagittal plane.

As used herein, the anatomic axes of the body, performance garment or wetsuit, will be described using the following terminology: Sagittal Plane, Coronal or Frontal Plant and Transverse (aka: Axial or Crossing) Planes. Consider three lines or axes running through a swimmer's body and intersecting at right angles at the swimmer's center of gravity, which also relate to corresponding planes of intersection. A longitudinal axis is a line drawn down the center of the standing body from the center of the head, through the torso and to the ground between the legs. A transverse axis is a line drawn from a first lateral side through to the opposite (second) lateral side, typically at or about the upper hip region or illiac crest, at the approximate center of gravity of the body and intersecting the longitudinal (and frontal) axis. A frontal axis is a line drawn from anterior to posterior sides of the body, at the approximate center of gravity of the body and intersecting the longitudinal (and transverse) axis. Corresponding planes of intersection are the Sagittal, Coronal and Transverse plane. The Sagittal plane is a plane that divides a body equally into left and right halves from head to toe. A Coronal plane is a plane that divides a body into front (anterior) and back (posterior) halves. The Sagittal and Coronal planes intersect along the longitudinal axis. The Transverse plane is a plane that divides the body into superior (upper) and inferior (lower) halves at or about the center of gravity of the body. The Transverse plane intersects the body along the transverse and frontal axes. A transverse plane can also describe a cross-section location of the body, at any point between the top of the head and the bottom of the feet, which divides the body into cranial (head) and caudal (tail) portions. It is parallel to the ground, which (in humans) separates the superior from the inferior, or put another way, the head from the feet.

As used herein, "roll" refers to rotation of the swimmer's torso or body about the longitudinal axis, wherein the Coronal and Sagittal planes rotate or twist, but not necessarily in equal amounts over their entire respective planes.

As used herein, "torso", means the trunk of the human body, a wetsuit or similar aquatic sports performance garment to at least the crotch region, without the head and arms, but optionally including the upper to mid-thigh region of the legs.

As used herein, the term "core" refers to the muscular structure of the central torso of a person. The major muscles of the core reside in the area of the belly, the mid- and lower back, and peripherally include the hips, the shoulders and to some extent, the neck region. Major muscles of the core include: the pelvic floor muscles, transversus abdominis, multifidus, internal and external obliques, rectus abdominis, erector spinae (sacrospinalis) especially the longissimus thoracis, and the diaphragm. Minor core muscles include the latissimus dorsi, gluteus maximus, and trapezius.

As used herein, "the body", refers to the entire human body, a wetsuit or similar aquatic sports performance garment, including the arms and legs, (without the hands or feet), but optionally including a hood for the head, gloves for the hands or boots for the feet.

As used herein, and unless otherwise specified, the term "about" or "approximately" means an acceptable error for a particular value as determined by one of ordinary skill in the art, which depends in part on how the value is measured or determined. In certain embodiments, the term "about" or "approximately" means within 1, 2, 3, or 4 standard deviations. In certain embodiments, the term "about" or "approximately" means within 30%, 25%, 20%, 15%, 10%, 9%, 8%, 7%, 6%, 5%, 4%, 3%, 2%, 1%, 0.5%, 0.1%, or 0.05% of a given value or range. In certain embodiments, the term "about" or "approximately" means within 40.0 mm, 30.0 mm, 20.0 mm, 10.0 mm 5.0 mm 1.0 mm, 0.9 mm, 0.8 mm, 0.7 mm, 0.6 mm, 0.5 mm, 0.4 mm, 0.3 mm, 0.2 mm or 0.1 mm of a given value or range. In certain embodiments, the term "about" or "approximately" means within 30.0 degrees, 20.0 degrees, 15.0 degrees, 10.0 degrees, 9.0 degrees, 8.0 degrees, 7.0 degrees, 6.0 degrees, 5.0 degrees, 4.0 degrees, 3.0 degrees, 2.0 degrees, 1.0 degrees, 0.9 degrees, 0.8 degrees, 0.7 degrees, 0.6 degrees, 0.5 degrees, 0.4 degrees, 0.3 degrees, 0.2 degrees, 0.1 degrees, 0.09 degrees. 0.08 degrees, 0.07 degrees, 0.06 degrees, 0.05 degrees, 0.04 degrees, 0.03 degrees, 0.02 degrees or 0.01 degrees of a given value or range.

As used herein, the term "arms-up" means any elevated position of the arms of the garment wherein the arms are protruding away from the main body of the garment, at an angle greater than 45 degrees, in any anterior to lateral orientation, wherein each sleeve is separated by the sagittal plane and parallel to or anterior to the coronal plane of the garment.

As used herein, the term "neoprene" refers to a synthetic rubber made by the polymerization of chloroprene, characterized by superior resistance (as to oils), and used especially for special-purpose clothing (i.e.: as gloves, aquatic sports performance garment and wetsuits).

As used herein, the term "aerated neoprene" refers to a type of neoprene which comprises multiple laminated layers, at least one of which is perforated and cut such that the final product is a sealed neoprene with individual pockets of air trapped inside the neoprene layers.

As used herein, the terms aquatic sports performance garment, aquatic garment, wetsuit and similar terms are used interchangeably and refer to any garment configured for and intended to enhance the performance of athletes involved in sports incorporating aquatic events including triathlon garments, aquatic compression garments, body suits and other swimwear. These garments provide drag reduction in the form of faster-than-skin surface coatings, warmth, reduce fatigue and additional buoyancy to the wearer, and are designed to enhance the speed and ease with which the wearer moves through the water while swimming.

As used herein, the term "musculoskeletal complex" refers to a combination of the muscular and skeletal systems working together and includes the bones, muscles, tendons and ligaments of the body. For example: a shoulder musculoskeletal complex means the bones, muscles, tendons and ligaments of the shoulder region of the body. As a further example: a hip musculoskeletal complex means the bones, muscles, tendons and ligaments of the hip region of the body.

As used herein, the terms "abut", "abuttable", "abutted", "adjoining", "adjacent", "proximity" and similar terms mean next to, aligned with, next to, touching, nearly touching, joining at an edge or a border or mating with another thing in a flush, seamless or near seamless manner so as to make a mating pair or mating edges. The terms are also meant to mean nearness in space or relationship, but not excluding the potential to be touching. The terms are also alternatively meant to mean that one thing may be as close to another thing as to be "in direct or nearly direct contact" (in proximity) with another thing along some point. The terms are also alternatively meant to mean that a first thing is within about 0.1 cm, within about 0.5 cm, within about 1.0 cm within about 2.0 cm, within about 4.0 cm, within about 6.0 cm, within about 8.0 cm, or within about 10.0 cm to a second thing. The terms are also meant to mean that items are "paired" or "mated together" either in their paired function, nearly in contact and functioning in unison, or at some point of contact.

As used herein, the terms "affix", "affixed", "affixable", "fix" or "fixed" means to attach, append, bind, join, integrate, add or fasten (something) to something else. This may be accomplished in a large number of ways including various types of fixation mediums such as glues, or epoxies (meant for either temporary or permanent fixation), including pastes and gum materials. Alternatively, an item may be affixed to something by means of sewing them together with a threading material. Still further, other types of attachment include various material welding techniques such as ultrasonic welding—an industrial technique whereby high-frequency ultrasonic acoustic vibrations are locally applied to work pieces being held together under pressure to create a solid-state weld. It is commonly used for plastics, various rubbers and polymers (i.e.: neoprene, nylon, polyester, polypropylene, polyurethanes, etc.), and especially for joining dissimilar materials. In ultrasonic welding, there are no connective threads, bolts, nails, staples, rivets, soldering materials, or adhesives necessary to bind the materials together. However, it is understood by one skilled in the art that the ultrasonic weld itself is a consolidation of two materials (the same or different) that have been welded or integrated together (melted together using high-frequency sound waves and pressure), creating a composite between the joined layers. One of skill in the art will recognize that the aforementioned definitions and means of attachment are not all-inclusive and would further understand that there are many alternative means for attaching or affixing two or more things such as similar and dissimilar fabrics and/or layered materials together.

As used herein the term "stiffness" means the rigidity of an object or material, or the extent to which an object or material resists deformation in response to an applied force. Said another way, stiffness is the resistance of an elastic body to deflection or deformation by an applied force. The stiffness, k, of a body is a measure of the resistance offered by an elastic body to deformation. For an elastic body with a single degree of freedom (DOF) (for example, stretching or compression of a rod), the stiffness k (N/m, lb./in) is defined as $k=F/\delta$, where, F is the force (N, lb.) applied on the body and $\delta$ (m, in) is the displacement produced by the force along the same degree of freedom (for instance, the change in length of a stretched spring). In the International System of Units, stiffness is typically measured in Newtons per meter (N/m). In Imperial units, stiffness is typically measured in pounds per inch (lb./in).

The complementary concept to stiffness is flexibility or pliability: the more flexible an object is, the less stiff it is. As used herein, "flexibility" means the quality of bending easily without breaking.

The inverse of stiffness is compliance (or sometimes elastic modulus), typically measured in units of meters per newton.

As used herein "rotational stiffness" is defined as k, given by $k=M/\theta$, where M is the applied moment $\theta$ is the rotation. In the SI system, rotational stiffness is typically measured in newton-meters per radian. In the SAE system, rotational stiffness is typically measured in inch-pounds per degree.

As used herein "elasticity" means the ability of an object or material to resume its normal shape after being stretched or compressed; stretchiness. In general, elastic modulus is not the same as stiffness. Elastic modulus is a property of the constituent material; stiffness is a property of a structure. That is, the modulus is an intensive property of the material; stiffness, on the other hand, is an extensive property of the solid body dependent on the material and the shape and boundary conditions. For example, for an element in tension or compression, the axial stiffness is $$k = \frac{AE}{L},$$

where A is the cross-sectional area, E is the (tensile) elastic modulus (or Young's modulus), and L is the length of the element.

Similarly, the rotational stiffness of a straight section is $$k = \frac{GJ}{L},$$

where "J" is the torsion constant for the section, "G" is the rigidity modulus of the material, Note that in SI, these units yield $$k : \frac{N \cdot m}{\text{rad}}.2$$

For the special case of unconstrained uniaxial tension or compression, Young's modulus can be thought of as a measure of the stiffness of a material.

The stiffness of a structure is of principal importance in many engineering applications, so the modulus of elasticity is often one of the primary properties considered when selecting a material. A high modulus of elasticity is sought when deflection is undesirable, while a low modulus of elasticity is required when flexibility is needed.

In summary: Young's modulus measures the resistance of a material to elastic (recoverable) deformation under load. A stiff material has a high Young's modulus and changes its shape only slightly under elastic loads (e.g. diamond). A flexible material has a low Young's modulus and changes its shape considerably (e.g. rubbers). Elasticity is the tendency of solid materials to return to their original shape after forces are applied on them. When the forces are removed, the object will return to its initial shape and size if the material is elastic. Stiffness is the rigidity of an object—the extent to which it resists deformation in response to an applied force. The complementary concept of stiffness is flexibility or pliability; the more flexible an object is, the less stiff it is. Relative stiffness of a material is the property that allows something to resist bending, stretching, twisting or other deformation under a load. It is function of the material's modulus of elasticity (see Young's modulus) and shape.

Provided herein is an aquatic sport performance garment configured to reduce fatigue of a user when the garment is worn, the garment having an aquatic sports performance garment material, the garment comprising: an upper torso portion comprising; a left sleeve portion having an left shoulder region, a left armpit region and a left sleeve outer edge; and a right sleeve portion having an right shoulder region, a right armpit region and a right sleeve outer edge; wherein the left sleeve portion of the garment is biased in an arms-up configuration, such that the left sleeve outer edge extends out generally anteriorly from a coronal plane of the garment at an angular range from about −15.0° to at least about +100.0° relative to a transverse plane transecting the upper torso at or about a top of the left shoulder region and a top of the right shoulder region, and wherein the left sleeve portion of the garment is further positioned approximately parallel to a sagittal plane of the garment, when the garment material is at rest, prior to being worn by the user, wherein the right sleeve portion of the garment is biased in an arms-up configuration, such that the right sleeve outer edge extends out generally anteriorly from the coronal plane of the garment at an angular range from about −15.0° to at least about +100.0° relative to the transverse plane, and wherein the right sleeve portion of the garment is further positioned approximately parallel to the sagittal plane of the garment, when the garment material is at rest, prior to being worn by the user.

Figure 2:
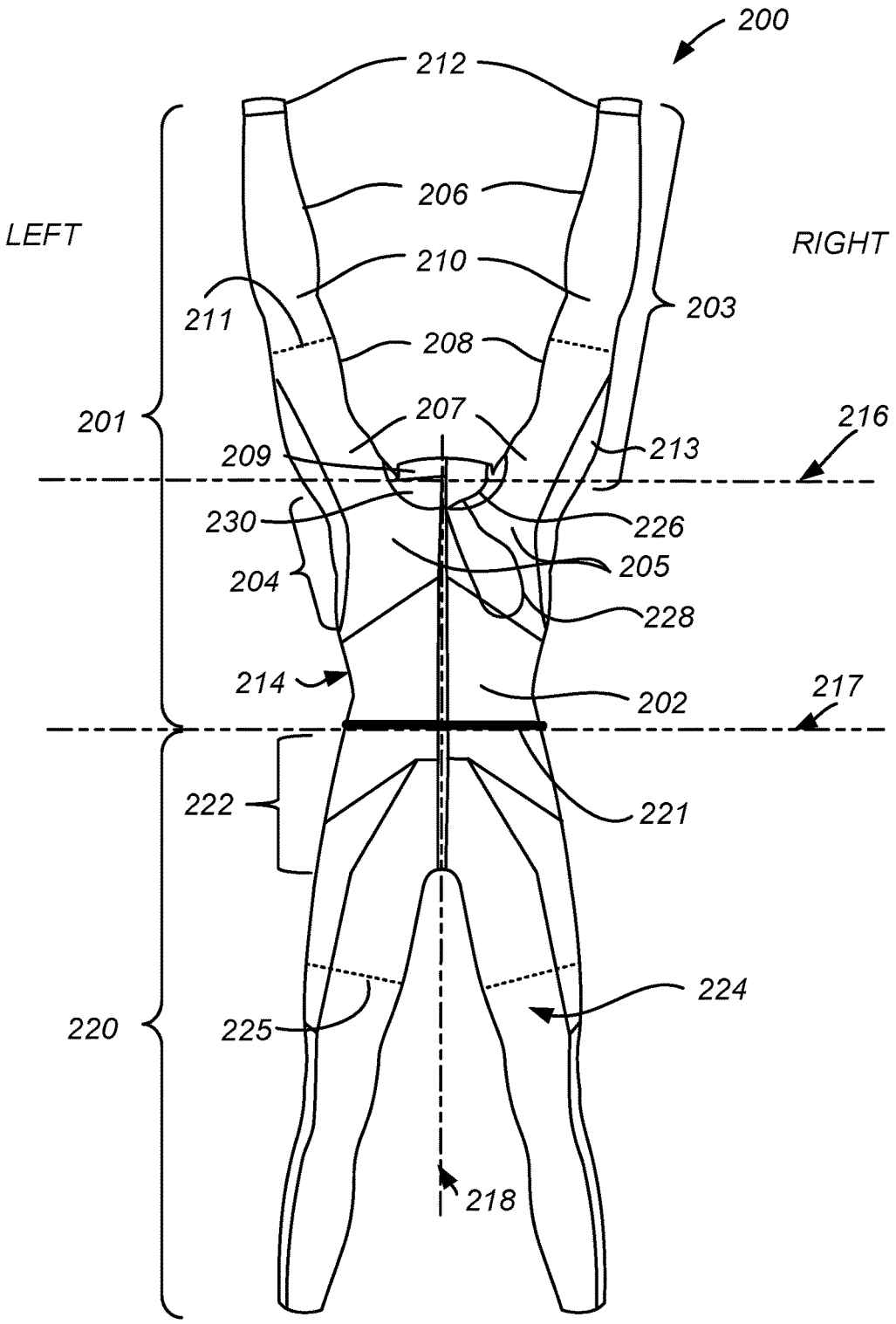
FIG. 2 is a back view of an illustrative embodiment of a sports performance garment illustrating a representative overhead arms position of the arms in an "arms-up" at-rest position in accordance with the teachings herein.
Figure 3:
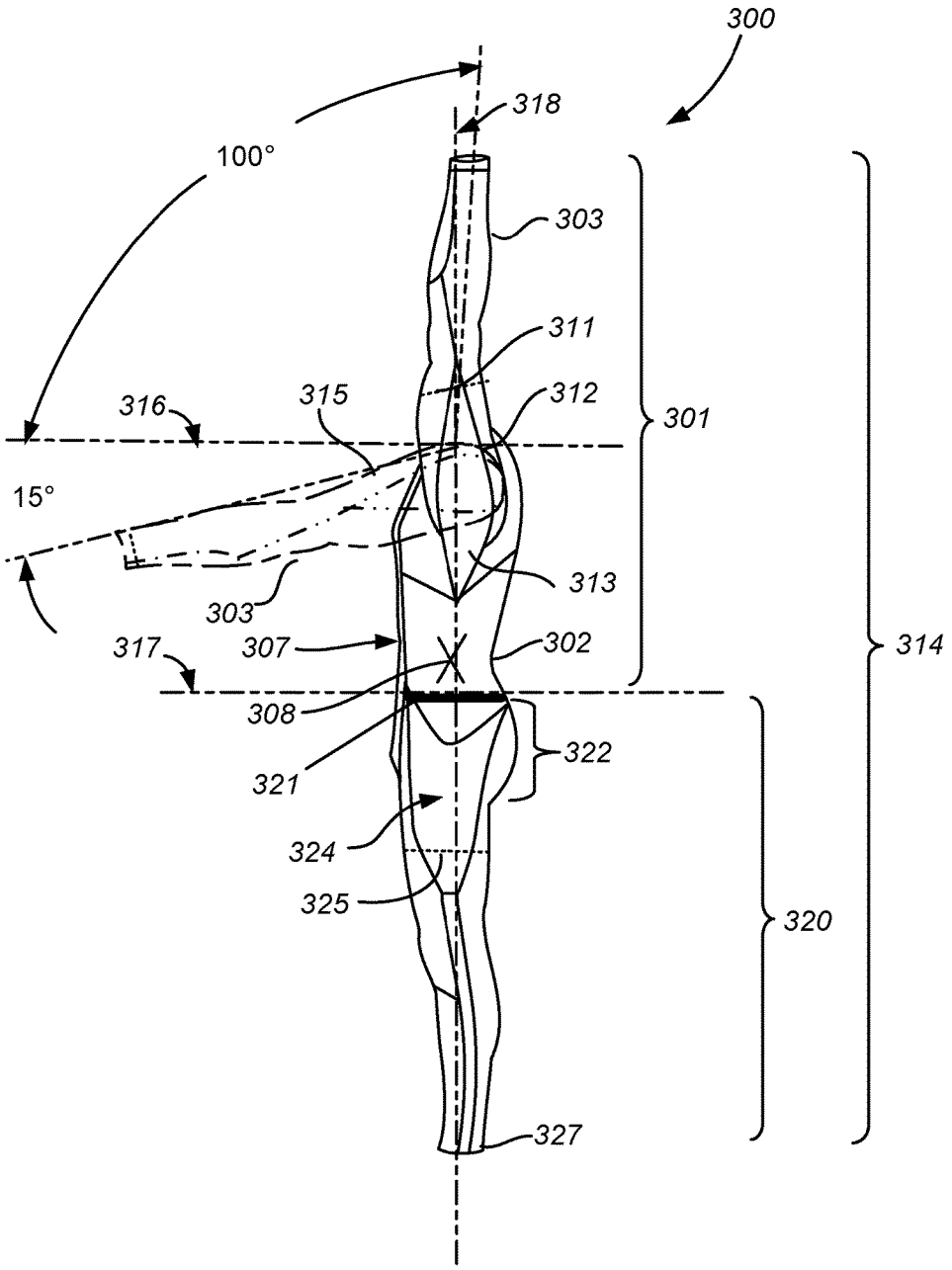
FIG. 3 is a left side view of an illustrative embodiment of a sports performance garment illustrating a representative range of positions for the arms in an "arms-up" at-rest position in accordance with the teachings herein.
Figure 4:
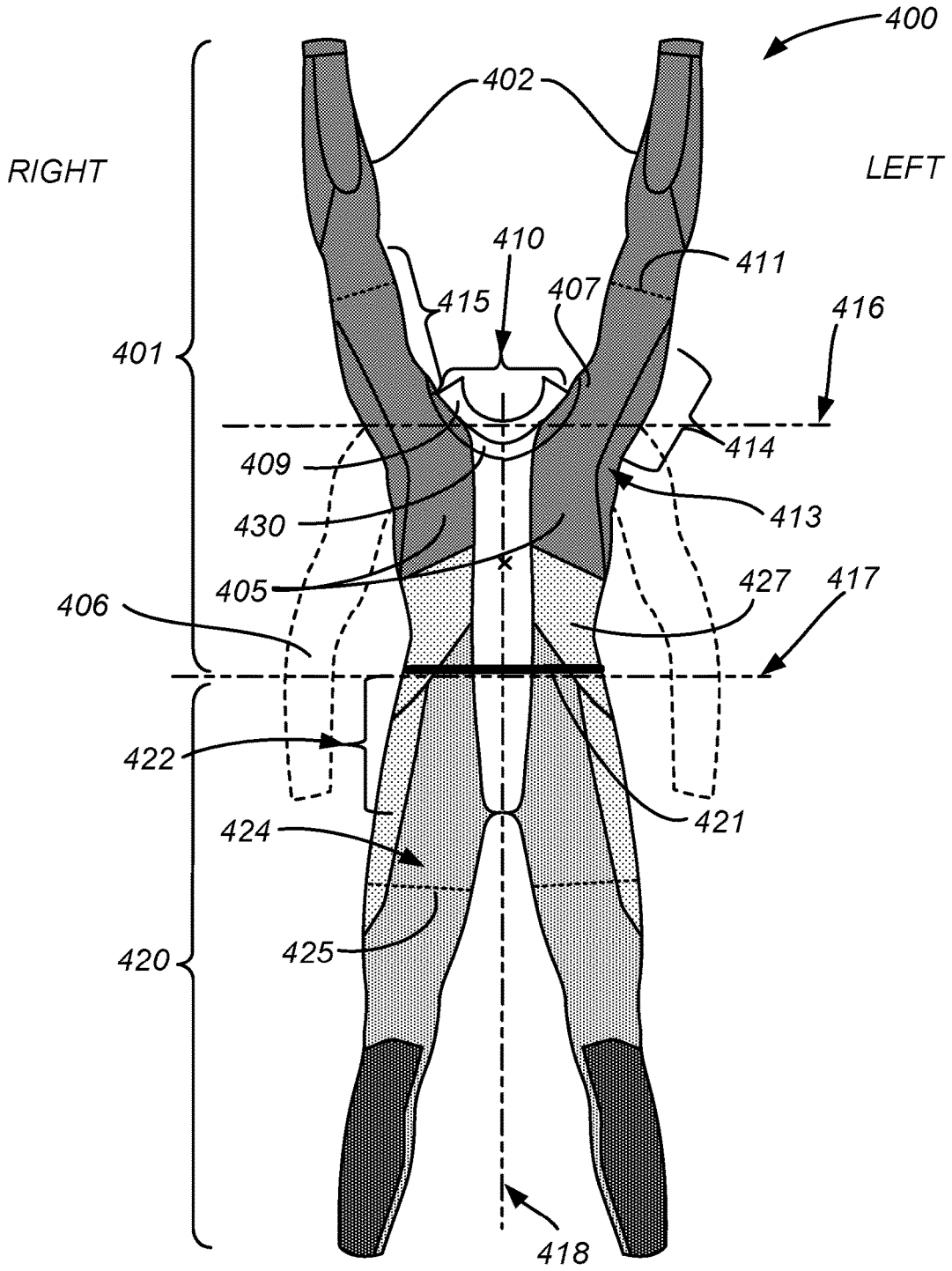
FIG. 4 is a front view of an illustrative example of a sports performance garment showing representative locations of various regions of the sports performance garment comprising variations in material composition and/or lining and panel structures in relation to other features of the sports performance garment in accordance with the teachings herein.
Figure 5:
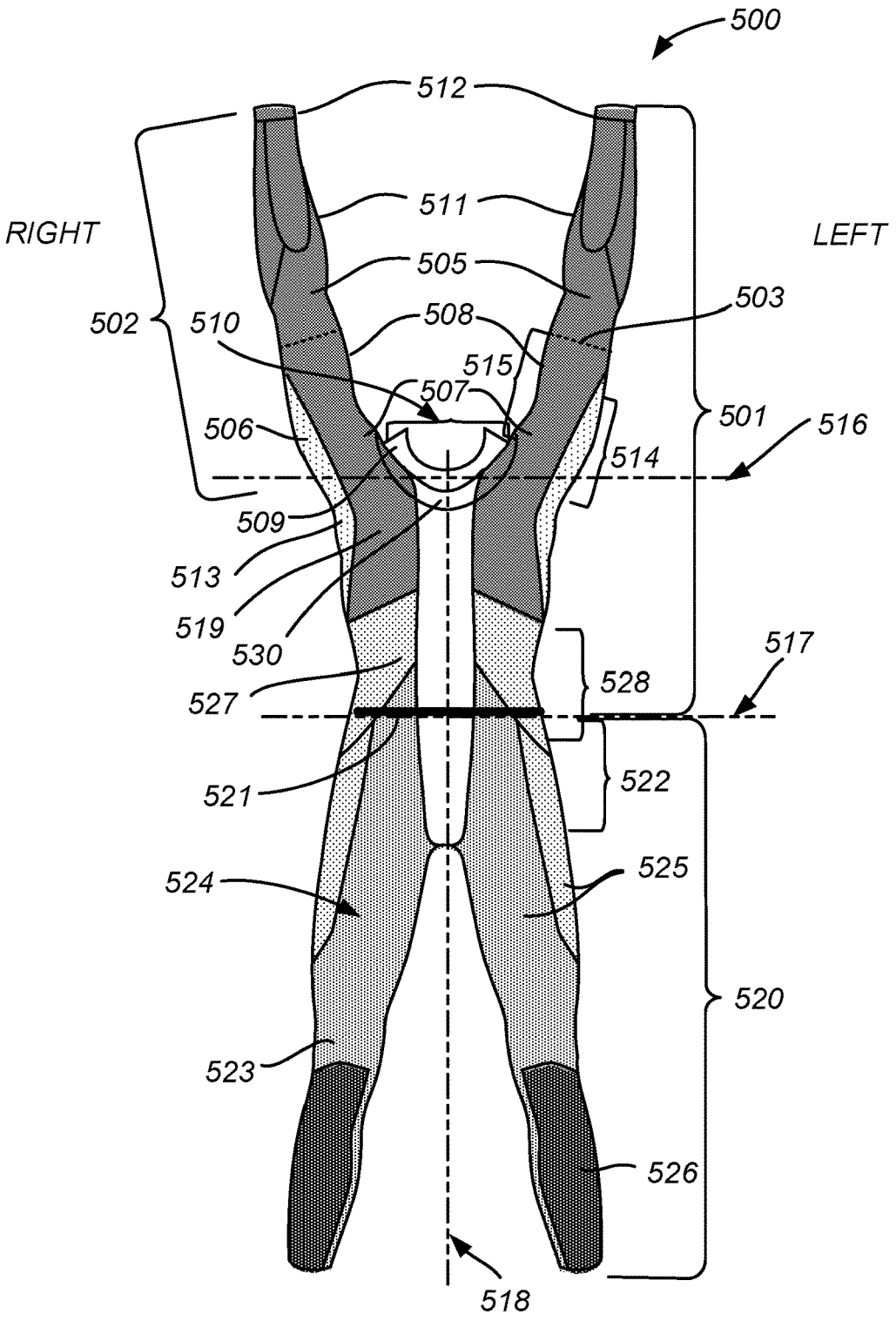
FIG. 5 is a another front view of an illustrative example of a sports performance garment illustrating representative positioning of multiple flexibility and restraint patterns in relation to other features of the sports performance garment in accordance with the teachings herein.

Referring to FIGS. 1, 2 and 3, one sees a front view, a back view and a side view of one illustration of an aquatic sports performance garment 100, 200, 300 comprising an upper torso portion 101, 201, 301 and a lower torso 120, 220, 320, abutting each other at or about a $1^{st}$ transverse plane 117, 217, 317, located at or about a waist region 121, 221, 321, and perpendicular to the sagittal plane 218 and the coronal plane 318. Alternatively, in some embodiments, the garment is configurable as a one-piece garment 314. Of primary interest, is the upper torso 101, 201, 301 comprising sleeves 103, 103*a*, 203, 303, which are cut, and assembled in a pattern such that when in a relaxed, or at rest state, each left and right outer sleeve portion 115, 315 is positioned approximately parallel to a sagittal plane 118, 218, and within a range from approximately −15 degrees to approximately +100 degrees from a $2^{nd}$ transverse plane 116, 216, 316, located on the upper torso at or about a top of the left shoulder region and a top of the right shoulder region 112, 207, 312 and perpendicular to the sagittal plane 218 and the coronal plane 318. Additionally, in some embodiments the sleeves are configurable wherein they are positioned an angled range measured from a lateral side of the garment, between −15 degrees (medially offset from parallel to the sagittal plane) to approximately 45 degrees laterally offset from the sagittal plane. Said another way, the sleeves may point toward the midline of the garment at an angle of approximately −15 degrees or away from midline at an angle of approximately 45 degrees and still be within the arms-up position from approximately −15 degrees to +100 degrees relative to the transverse plane, as measured from the top of the shoulders. Additionally, the sleeves 103, 103*a*, 203, 303 could be described as being in an arms-up state wherein they are configurable to an elevated state that is approximately 15 degrees below horizontal from a transverse plane 116, 216, 316 that is perpendicular to the shoulder region 112, 207, 312, to an elevated state that is approximately 10 degrees past the coronal plane 318 towards the posterior side of the garment above the head of a user and further positioned at an angle range within −15 degrees to +45 degrees from a lateral side of the garment relative to the sagittal plane of the garment.

Figure 6:
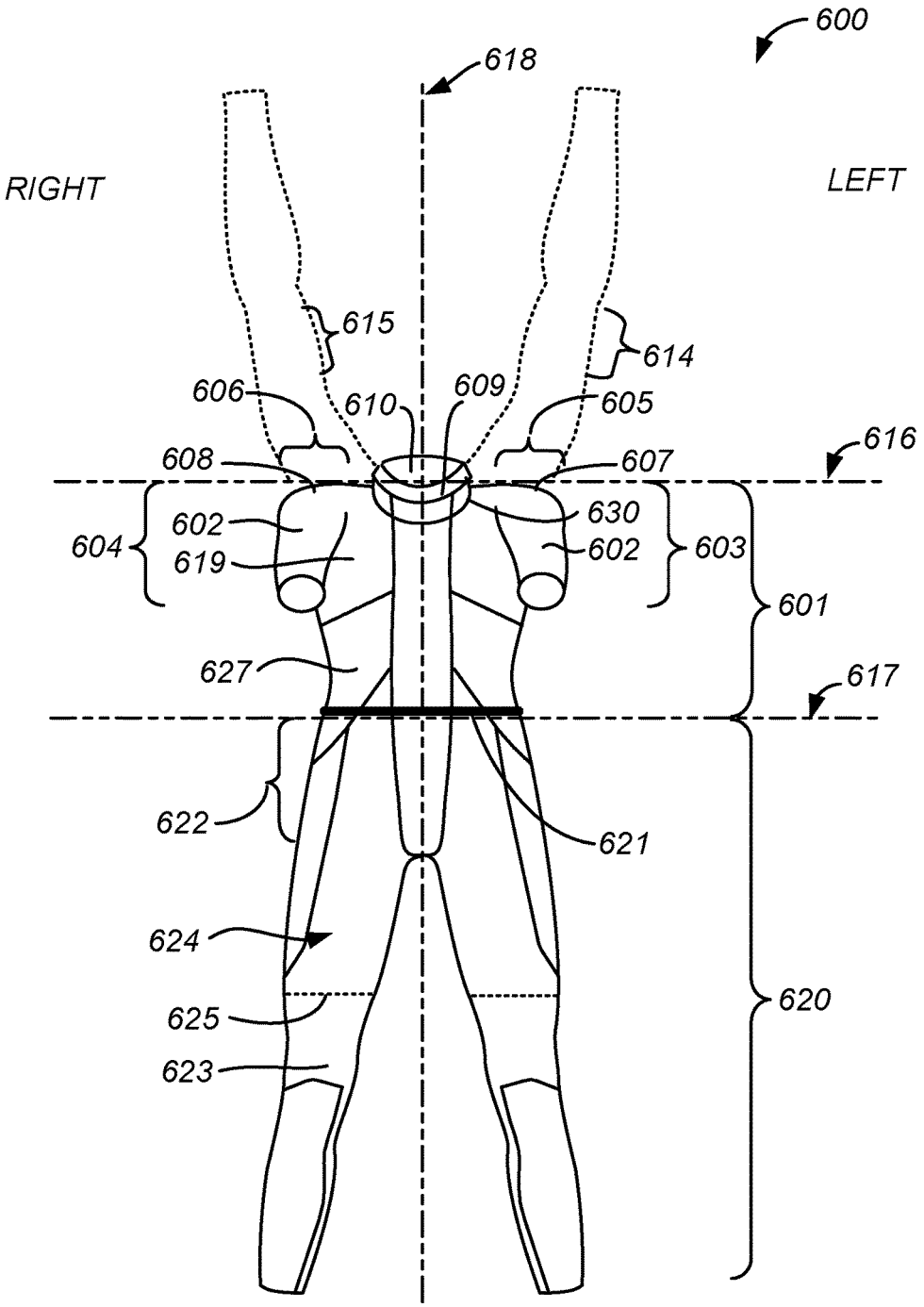
FIG. 6 is a another front view of an illustrative embodiment of a sports performance garment illustrating representative multiple possible positions of the arms in an "arms-up" at-rest anterior and overhead position with the arms approximately parallel to the sagittal plane, in accordance with the teachings herein.
Figure 7:
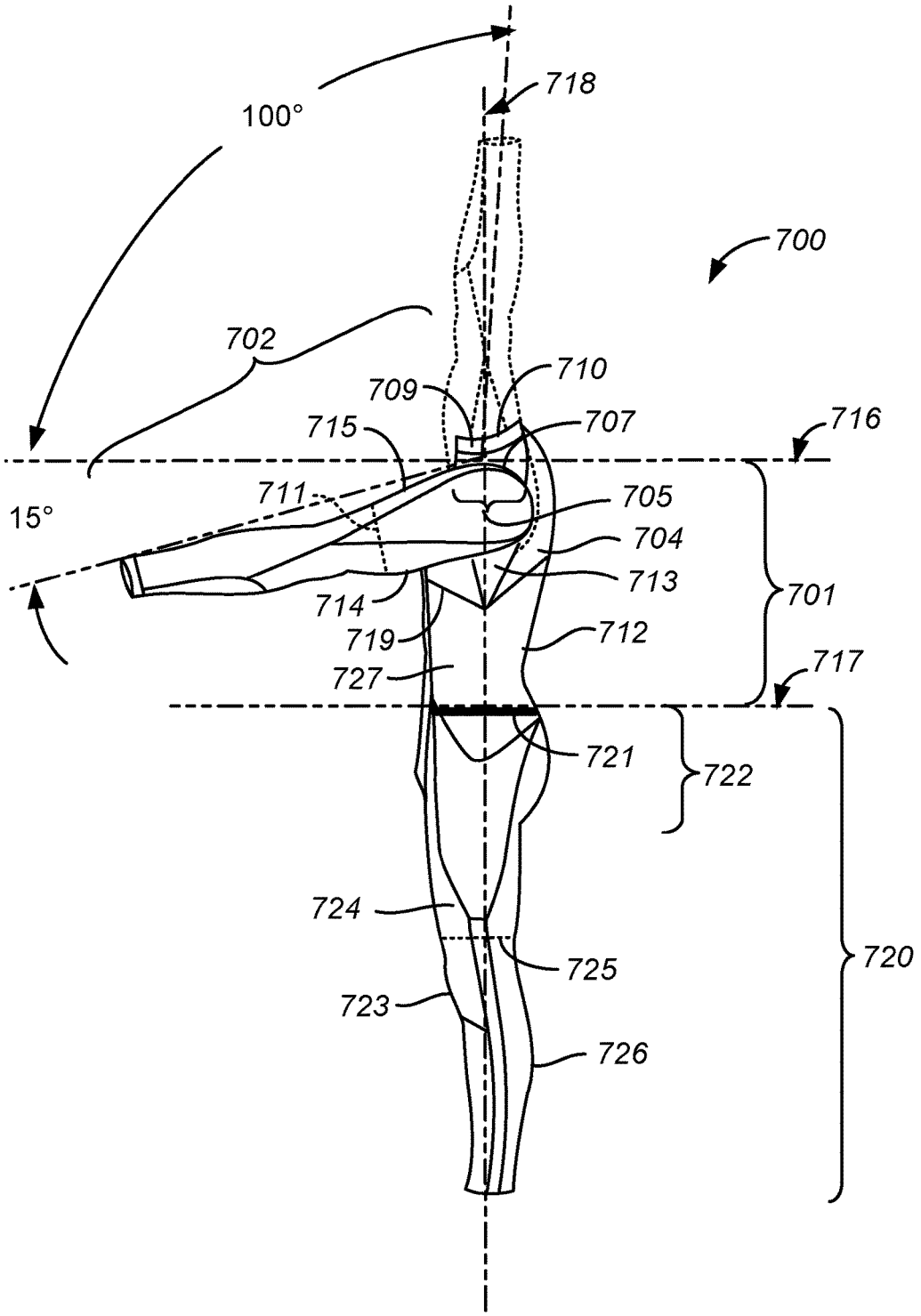
FIG. 7 is another left side view of an illustrative embodiment of a sports performance garment illustrating a representative range of positions for the arms in an "arms-up" at-rest anterior and overhead position with the arms approximately parallel to the sagittal plane, in accordance with the teachings herein.

By comparison, a traditional wetsuit or other traditional sports aquatic garment would have the sleeves patterned and constructed such that they rest essentially parallel or adjacent to the lateral sides of the garment as reflected in FIG. 1 showing the traditional position for sleeves 106 in dashed lines and labelled "Traditional", also shown in FIG. 6 and labelled as 406.

Provided herein is an aquatic sports performance garment configured to reduce fatigue of a user when the garment is worn, the garment having an aquatic sports performance garment material, the garment comprising: an upper torso portion comprising; a left sleeve portion having an left shoulder region, a left armpit region and a left sleeve outer edge; and a right sleeve portion having an right shoulder region, a right armpit region and a right sleeve outer edge; wherein the left sleeve portion of the garment is biased in an arms-up configuration, such that the left sleeve outer edge extends out generally laterally relative to a sagittal plane of the garment from a left lateral aspect of the garment at an angular range from about −15.0° to at least about +100.0° relative to a transverse plane transecting the upper torso at or about a top of the left shoulder region and a top of the right shoulder region, and wherein the left sleeve portion of the garment is further positioned in a range that is approximately parallel to, or anterior to, a coronal plane of the garment, when the garment material is at rest, prior to being worn by the user, wherein the right sleeve portion of the garment is biased in an arms-up configuration, such that the right sleeve outer edge extends out generally laterally relative to the sagittal plane from a right lateral aspect of the garment at an angular range from about −15.0° to at least about +100.0° relative to the transverse plane, and wherein the right sleeve portion of the garment is further positioned in a range that is approximately parallel to, or anterior to, a coronal plane of the garment, when the garment material is at rest, prior to being worn by the user.

Referring once again to FIGS. 1 and 3 an alternative embodiment of the upper torso 101 of the aquatic sports performance garment 100 illustrates how the left and right sleeve portions 103*a* of the garment (shown in lateral placement, in dashed lines) are configurable such that the left and right sleeve portions of the garment are biased in an arms-up configuration, wherein the sleeve outer edges 115*a* extends out generally laterally relative to a sagittal plane 118 of the garment from each lateral aspect of the garment at an angular range from about −15.0° to at least about +100.0° relative to a transverse plane 116 transecting the upper torso at or about a top of the left shoulder region and a top of the right shoulder region 112, and wherein the outer sleeve portions of the garment are further positioned in a range that is approximately parallel to, or anterior to, a coronal plane 318 of the garment, such as when viewed from the side, as in FIG. 3, when the garment material is at rest. The anterior placement angle can be an angle that is as little as zero (0) degrees or to about 45 degrees anterior of the coronal plane and anywhere within the approximate −15 degree to approximate +100 degree range from the transverse plane 116, 316.

In any embodiment of the aquatic sports performance garment, the garment material in the left shoulder region, left armpit region, right armpit region and right armpit region comprises a material thickness from about 0.5 mm to about 2.5 mm. In some embodiments of the aquatic sports performance garment, the garment material in the left shoulder region, left armpit region, right armpit region and right armpit region comprises a material thickness from about 0.5 mm to about 7.0 mm. The difference in the ranges for material thicknesses has to do with the application of the garment. For example, in a high performance triathlon garment or a surfing garment, the user would desire and require thinner material in the shoulders and armpits in order to afford greater mobility and faster reaction time, without sacrificing endurance. Alternatively, in deep water scuba or cold water triathlon and surfing environments, a user would desire thicker materials to preserve body heat and prevent isolated hypothermia to key muscle groups in the upper torso regions. Further still, some users such as Special Forces military personnel would ultimately require a variety of different thickness high performance aquatic garments to enable deployment in all areas and environments on the globe.

In any embodiment of the aquatic sports performance garment, the garment material in the left shoulder region, left armpit region, right armpit region and right armpit region comprises a modulus of elasticity from 0.31 $kg/cm^2$ at 50% elongation to 4.14 $kg/cm^2$ at 300% elongation.

In any embodiment of the aquatic sports performance garment, the upper torso portion, 101, 201, 301, 401, 501, 601, 701, further comprises: a neck region 130, 230, 430, 530 or 630; a chest (pectoralis) region 105, 405, 519, 619 or 719; an upper back (trapezius) region 205; an upper (latissimus dorsi) region 204 and 704, an abdominal region 107, 307, 427, 527, 627 and 727; a lateral oblique (oblique abdominal) region 214, 308, 528; and a mid-to-low back (thoraco-lumbar) region 202, 302 and 712.

In addition to the thickness of material and the assembled pattern of the garment components, it is equally important to the user that the garment material has the proper modulus of elasticity in the appropriate regions of the garment. The materials used for these garments must have variable moduli that can be strategically placed in key locations, such as the shoulders, and armpits in order to assure that the user is able to maximize their performance, while minimizing their level of fatigue when using the garment. If the user is constantly fighting a stiff material with a high modulus of elasticity, they become fatigued much faster. Whereas in some locations, a stiffer material with a higher modulus of elasticity may be desired, for example, in the core (abdominal and mid-to-low back) region, in order to provide additional support for the user.

In any embodiment of the aquatic sports performance garment 100, 200, 400, 500, 600 or 700, described herein, the neck region 130, 230, 430, 530, 630 comprises a large collar portion; and a free-floating flexible collar 109, 209, 409, 509, 609 or 709 with a neck opening 110, 410, 510, 610 or 710. The large collar portion is patterned and configured specifically to move with and improve flexibility in the shoulder regions 112, 207, 312, 407, 507, 605, 606, 607, 608, 705 and 707, and in the armpit regions 113, 313, 413, 513 and 713. Further, the free-floating flexible collar 109, 209, 409, 509, 609 and 709 comprises highly flexible garment material configured to seal around a neck of the user to significantly reduce or prevent water from entering the garment through the neck region.

In any embodiment of the aquatic sports performance garment described herein, the neck region, chest (pectoralis) region, and upper back (trapezius) region further comprise a material thickness from about 1.0 mm to about 7.0 mm.

In some embodiments of the aquatic sports performance garment described herein, the neck region, chest (pectoralis) region, and upper back (trapezius) region further comprise a material thickness from about 1.0 mm to about 2.5 mm.

As with the material thickness in the shoulder and armpit regions, the difference in the ranges for material thicknesses of the neck region, chest (pectoralis) region, and upper back (trapezius) region has to do with the application of the garment. For example, in a high performance triathlon garment or a surfing garment, the user would desire and require thinner material in the neck region, chest (pectoralis) region, and upper back (trapezius) region in order to have fluid movement and coordination with the shoulders and armpits in order to afford greater mobility and faster reaction time, without sacrificing endurance. Alternatively, in deep water scuba or cold water triathlon and surfing environments, a user would desire thicker materials to preserve body heat and prevent isolated hypothermia to key muscle groups in the upper torso regions. Further still, some users such as Special Forces military personnel would ultimately require a variety of different thickness high performance aquatic garments to enable deployment in all areas and environments on the globe.

In any embodiment of the aquatic sports performance garment, the free-floating flexible collar, the abdominal region, the lateral oblique (oblique abdominal) region or the mid-to-low back (thoraco-lumbar) region further comprise a material thickness from about 1.0 mm to about 7.0 mm. In some embodiments of the aquatic sports performance garment, the free-floating flexible collar, the abdominal region, the lateral oblique (oblique abdominal) region or the mid-to-low back (thoraco-lumbar) region further comprise a material thickness from about 1.0 mm to about 3.0 mm.

As with the material thickness in the shoulder and armpit regions, the difference in the ranges for material thicknesses of the free-floating flexible collar, the abdominal region, the lateral oblique (oblique abdominal) region or the mid-to-low back (thoraco-lumbar) region are required for a variety of reason. For example, around the neck region, the material thickness needs to vary in order to provide comfort to the user so as to avoid a feeling of choking, yet still maintain a high level of waterproofing around the next to minimize water penetration of the garment. In the lateral obliques, abdominal region and mid-back regions, the user will want a mixed combination of flexibility and stiffness to provide support for the core, yet flexibility under the arms and around the sides of the chest.

In any embodiment of the aquatic sports performance garment, the garment material of the upper back (trapezius) region; the upper (latissimus dorsi) region, the chest (pectoralis) region; the abdominal region; or the mid-to-low back (thoraco-lumbar) region comprises an embedded liner that inhibits elongation of the garment material therein more than the garment material in the left shoulder region, the left armpit region, the right shoulder region or the right armpit region.

The embedded liner used with the aquatic sports performance garment can be crucial in that the proper selection affords the user with varying degrees of uni-directional and/or multi-directional elasticity. Some liners only allow for uni-direction stretch, some liners allow for multi-directional stretch, while still others allow for multi-directional stretch, but to a different degree in longitudinal stretch versus horizontal or diagonal stretch. As an example, the shoulder is the most rotationally flexibly joint in the body. The neck region of the body is next most flexible and must work in concert with the shoulder regions. Therefore, the garment is designed to have the highest degree of flexibility with a multi-directional liner in these regions. Whereas the abdominal and mid back regions are designed with unilateral, horizontal stretch in the liner of the garment material to provide support for the core. Alternatively, the upper back (trapezius) region; the upper (latissimus dorsi) region and the chest (pectoralis) region need varying degrees of longitudinal stretch, horizontal and diagonal stretch to allow for rolling and stretching of the chest and upper body, working with the arms and shoulders of the user.

In any embodiment of the aquatic sports performance garment, the left sleeve portion and the right sleeve portion comprise: short sleeves 111, 211, 311, 411, 503 or 711, terminating between an elbow 210 or 510 and a biceps region 208 or 508; or long sleeves 103, 103*a*, 203, 402, 502 or 702 terminating between an elbow 210 or 510 and a wrist 212 or 512.

In any embodiment of the aquatic sports performance garment, the garment material of the left shoulder region, the left armpit region, the right shoulder region, the right armpit region comprises multi-directional elasticity comprising elongation having a range from: about 50% to about 400%; about 100% to about 350%; about 100% to about 300%; about 100% to about 250%; about 100% to about 200%; or about 100% to about 150%.

In some embodiments of the aquatic sports performance garment 100, 200, 300, 400, 500, 600 or 700, the aquatic sports performance garment further comprises: a separable lower torso portion 120, 220, 320, 420, 520, 620 or 720, also having an aquatic sports performance garment material. In these embodiments the upper torso portion is configurable such that the edges of the upper torso garment either overlaps the edges of the lower torso garment; or the upper torso portion edges abut with the lower torso edges at or about a mid-section of the torso, typically at or about a 1$^{st}$ transverse plane 117, 217, 317, 417, 517, 617, 717, commonly near the waist region 121, 221, 321, 421, 521, 621 or 721. Alternatively, in some embodiments, the aquatic sports performance garment is provided as a one-piece unit with an inseparable lower torso, such as 314.

The lower torso portion typically comprises; a waist region 121, 221, 321, 421, 521, 621, 721; a pelvic girdle region 122, 222, 322, 422, 522, 622 722; including a crotch region 123; and left leg and right leg portions 124, 224, 324, 424, 524 below the crotch region. In some embodiments of the aquatic sports performance garment, the left leg portion and the right leg portion comprise: a short leg portion 125, 225, 325, 425, 625, 725 terminating at or above a knee 523, 623, 723 or in a thigh region 525, 624, 724; or a long leg portion extending below the knee in to the calf region 526, 726 or the ankle region 327.

In any embodiment of the aquatic sports performance garment, 100, 200, 300, 400, 500, 600 or 700, the left sleeve portion and the right sleeve portion 102, 103, 402, 502, 602, 603, 604 have material thicknesses in a range comprising: about 0.5 mm to about 7.0 mm; about 1.0 mm to about 6.0 mm; about 1.0 mm to about 5.0 mm; about 1.0 mm to about 4.0 mm; about 1.0 mm to about 3.0 mm; about 1.0 mm to about 2.0 mm; about 0.5 mm to about 2.0 mm; about 0.5 mm to about 1.5 mm; about 1.0 mm to about 1.5 mm. or about 0.5 mm to about 1.0 mm.

In any embodiment of the aquatic sports performance garment, the sleeves of the aquatic sports performance garment comprise an inner edge sleeve portion 114, 414, 514, 614, 714; an outer edge sleeve portion, 115, 115*a*, 415, 515, 615, 715; a forearm region, 206, 511, an elbow region, 210, 505; and a triceps/teres minor region, 213, 506. In any of the sleeve embodiments, the material thicknesses are in a range comprising: about 0.5 mm to about 7.0 mm; about 1.0 mm to about 6.0 mm; about 1.0 mm to about 5.0 mm; about 1.0 mm to about 4.0 mm; about 1.0 mm to about 3.0 mm; about 1.0 mm to about 2.0 mm; about 0.5 mm to about 2.0 mm; about 0.5 mm to about 1.5 mm; about 1.0 mm to about 1.5 mm. or about 0.5 mm to about 1.0 mm.

In any embodiment of the aquatic sports performance garment, the material for constructing the upper back (trapezius) region comprises multi-directional elasticity comprising elongation having a range from: about 50% to about 400%; about 100% to about 350%; about 100% to about 300%; about 100% to about 250%; about 100% to about 200%; or about 100% to about 150%.

In any embodiment of the aquatic sports performance garment, 100, 200, 300, 400, 500, 600 or 700, the material for constructing the upper (latissimus dorsi) region, the chest (pectoralis) region, the abdominal region, the lateral oblique region or the mid-to-low back (thoraco-lumbar) region comprises uni-directional elasticity comprising elongation having a range from: about 50% to about 400%; about 100% to about 350%; about 100% to about 300%; about 100% to about 250%; about 100% to about 200%; or about 100% to about 150%.

In any embodiment of the aquatic sports performance garment, the material for constructing the upper (latissimus dorsi) region, the chest (pectoralis) region, the abdominal region, the lateral oblique region or the mid-to-low back (thoraco-lumbar) region comprises multi-directional elasticity comprising elongation having a range from: about 50% to about 400%; about 100% to about 350%; about 100% to about 300%; about 100% to about 250%; about 100% to about 200%; or about 100% to about 150%.

In any embodiment of the aquatic sports performance garment, 100, 200, 300, 400, 500, 600 or 700, the material comprises neoprene. Further still, in any embodiment of the aquatic sports performance garment, 100, 200, 300, 400, 500, 600 or 700, the garment material alternatively comprises a rubber; a nylon; a polyester; a polypropylene; Lycra®; or Spandex®.

In some embodiments, the aquatic sports performance garment the upper torso and/or the lower torso portion further comprises a quick opening feature 226. In some embodiments of the aquatic sports performance garment, the quick opening feature(s) 226 is (are) positioned: on an anterior aspect of the garment; on a lateral aspect of the garment; or on a posterior aspect of the garment. In some embodiments of the aquatic sports performance garment, the quick opening feature is a zipper. In some embodiments of the aquatic sports performance garment, the quick opening feature comprises a Velcro® attachment. In some embodiments of the aquatic sports performance garment, the quick opening feature comprises: a hook; a loop; a rail, or a lip. In some embodiments of the aquatic sports performance garment, the quick opening feature 226 further comprises a quick opening assist device 228, such as a pull cord to aid the user in opening and closing the quick opening feature, when it is in a hard to reach area, such as the back of the garment.

In any embodiment of the aquatic sports performance garment, the material comprises a liner. In some embodiments, the liner comprises nylon. In any one of the embodiments the liner provides uni-lateral elongation properties or multi-lateral elongation properties to the garment materials. In any embodiment of the aquatic sports performance garment, the aquatic sports performance garment material comprises a configurable embedded liner that limits the percentage and direction of elongation of the garment material, wherein the percentage of elongation of the garment materials is from at least 50% at least 400%, and wherein the direction of elongation of the garment materials is either uni-direction or multi-directional. As noted earlier, the degree of elongation, the direction of elongation in the liner used in the material of the various components and their location in the aquatic sports performance garment have a direct impact on the performance of the user of the garment.

Provided herein is a method of manufacturing an aquatic sports performance garment comprising: providing an aquatic sports performance material; patterning an upper torso portion comprising; a neck region; a chest (pectoralis) region; an upper back (trapezius) region; an upper (latissimus dorsi) region, an abdominal region; a lateral oblique (oblique abdominal) region; and a mid-to-low back (thoraco-lumbar) region; wherein the neck region comprises a large collar portion; and a free-floating flexible collar with a neck opening; patterning a left sleeve portion having a left shoulder region, a left armpit region and a left sleeve outer edge; patterning a right sleeve portion having a right shoulder region, a right armpit region, and a right sleeve outer edge; wherein the left sleeve portion of the garment is biased in an arms-up configuration, such that the left sleeve outer edge extends out generally anteriorly from a coronal plane of the garment at an angular range from about −15.0° to at least about +100.0° relative to a second transverse plane transecting the upper torso at or about a top of the left shoulder region and a top of the right shoulder region, and wherein the left sleeve portion of the garment is further positioned approximately parallel to a sagittal plane of the garment, when the garment material is at rest, prior to being worn by a user, and wherein the right sleeve portion of the garment is biased in an arms-up configuration, such that the right sleeve outer edge extends out generally anteriorly from the coronal plane of the garment at an angular range from about −15.0° to at least about +100.0° relative to the second transverse plane, and wherein the right sleeve portion of the garment is further positioned approximately parallel to the sagittal plane of the garment, when the garment material is at rest, prior to being worn by the user, and wherein the upper-torso portion of the garment covers the upper-torso of the user from a first transverse plane 117, 217, 317, 417, 517, 617, 717, at or about a waist of the user to a neck region.

Provided herein is a method of manufacturing an aquatic sports performance garment comprising: providing an aquatic sports performance material; patterning an upper torso portion comprising; a neck region with a neck opening; a chest (pectoralis) region; an upper back (trapezius) region; an upper (latissimus dorsi) region, an abdominal region; a lateral oblique (oblique abdominal) region; and a mid-to-low back (thoraco-lumbar) region; wherein the neck opening comprises the free-floating flexible collar, patterning a left sleeve portion having a left shoulder region, a left armpit region and a left sleeve outer edge; patterning a right sleeve portion having a right shoulder region, a right armpit region, and a right sleeve outer edge; wherein the left sleeve portion of the garment is biased in an arms-up configuration, such that the left sleeve outer edge extends out generally laterally relative to a sagittal plane of the garment from a left lateral aspect of the garment at an angular range from about −15.0° to at least about +100.0° relative to a second transverse plane transecting the upper torso at or about a top of the left shoulder region and a top of the right shoulder region, and wherein the left sleeve portion of the garment is further positioned in a range that is approximately parallel to, or anterior to, a coronal plane of the garment, when the garment material is at rest, prior to being worn by the user, and wherein the right sleeve portion of the garment is biased in an arms-up configuration, such that the right sleeve outer edge extends out generally laterally relative to the sagittal plane from a right lateral aspect of the garment at an angular range from about −15.0° to at least about +100.0° relative to the second transverse plane, 116, 216, 316, 416, 516, 616, 716 and wherein the right sleeve portion of the garment is further positioned in a range that is approximately parallel to, or anterior to, a coronal plane of the garment, when the garment material is at rest, prior to being worn by the user. In some embodiments the method further comprises: patterning a quick opening feature in the upper torso portion; wherein the quick opening feature is positioned: on an anterior aspect of the garment; on a lateral aspect of the garment; or on a posterior aspect of the garment. In some embodiments of the method, the quick opening feature is a zipper. In some embodiments of the method, the quick opening feature comprises a Velcro® attachment. In some embodiments of the method, the quick opening feature comprises: a hook; a loop; a rail, or a lip. In some embodiments the method further comprises: patterning a lower torso portion, abuttable to, or affixable to, the upper torso portion comprising; a waist region, a pelvic girdle region, a crotch region, a left leg portion and a right leg portion; wherein the lower-torso portion covers the lower torso of the user from the first transverse plane 117, 217, 317, 417, 517, 617, 717, at or below the waist of the user to a portion of the body to at least an area below the pelvic girdle. In some embodiments the method further comprises: affixing the lower-torso portion to the upper torso portion to form a one-piece aquatic sports performance garment. In some embodiments of the method, the left sleeve portion and the right sleeve portion comprise: patterning a short sleeve terminating between an elbow region and a biceps region; or patterning a long sleeve terminating between an elbow region and a wrist. In some embodiments of the method, the left leg portion and the right leg portion comprise: a short leg portion terminating at or above a knee; or a long leg portion extending below the knee. In some embodiments the method further comprises: providing a thermally insulating material having a thickness in a range from about 0.5 mm to about 7.0 mm. In some embodiments of the method, the thermally insulating material comprises: a neoprene; a rubber; nylon; polyester; a polypropylene; Lycra®; or Spandex®. In some embodiments the method further comprises: providing the material with multi-directional elasticity in the left shoulder region, the left armpit region, the right shoulder region, the right armpit region and the upper back (trapezius) region; and providing material with uni-directional elasticity; in the upper-lateral (latissimus dorsi) region, in the chest (pectoralis) region, in the abdominal region, in the lateral oblique region, and in the mid-to-low back (thoraco-lumbar) region.

Provided herein is a wetsuit comprising: a material providing thermal insulation to a user thereof; an upper torso portion comprising a neck region with an opening; and a left sleeve portion having an upper left shoulder region, a left armpit region and a left sleeve outer edge; and a right sleeve portion having an upper right shoulder region, a right armpit region and a right sleeve outer edge; wherein the left sleeve portion of the garment is biased in an arms-up configuration, such that the left sleeve outer edge extends out generally anteriorly from a coronal plane of the garment at an angular range from about −15.0° to at least about +100.0° relative to a second transverse plane, 116, 216, 316, 416, 516, 616, 716, transecting the upper torso at or about a top of the left shoulder region and a top of the right shoulder region, and wherein the left sleeve portion of the garment is further positioned approximately parallel to a sagittal plane 118, 218, 418, 518, 618 of the garment, when the garment material is at rest, prior to being worn by the user, wherein the right sleeve portion of the garment is biased in an arms-up configuration, such that the right sleeve outer edge extends out generally anteriorly from the coronal plane 318, 718 of the garment at an angular range from about −15.0° to at least about +100.0° relative to the second transverse plane, and wherein the right sleeve portion of the garment is further positioned approximately parallel to the sagittal plane of the garment, when the garment material is at rest, prior to being worn by the user, wherein the left sleeve portion and the right sleeve portion comprise; short sleeves terminating between an elbow and a biceps region; or long sleeves terminating between an elbow and a wrist, a lower torso portion having an aquatic sports performance garment material, the lower torso portion comprising; a waist region, a pelvic girdle region, including a crotch region; and a left leg portion and a right leg portion below the crotch region; wherein the left leg portion and the right leg portion comprise; a short leg portion terminating at or above a knee; or a long leg portion extending below the knee.

Provided herein is a wetsuit comprising: a material providing thermal insulation to a user thereof; an upper torso portion comprising; a left sleeve portion having an upper left shoulder region, a left armpit region and a left sleeve outer edge; and a right sleeve portion having an upper right shoulder region, a right armpit region and a right sleeve outer edge; wherein the left sleeve portion of the garment is biased in an arms-up configuration, such that the left sleeve outer edge extends out generally laterally relative to a sagittal plane 118, 218, 418, 518, 618 of the garment from a left lateral aspect of the garment at an angular range from about −15.0° to at least about +100.0° relative to a second transverse plane transecting the upper torso at or about a top of the left shoulder region and a top of the right shoulder region, and wherein the left sleeve portion of the garment is further positioned in a range that is approximately parallel to, or anterior to, a coronal plane 318, 718 of the garment, when the garment material is at rest, prior to being worn by the user, wherein the right sleeve portion of the garment is biased in an arms-up configuration, such that the right sleeve outer edge extends out generally laterally relative to the sagittal plane from a right lateral aspect of the garment at an angular range from about −15.0° to at least about +100.0° relative to the second transverse plane, and wherein the right sleeve portion of the garment is further positioned in a range that is approximately parallel to, or anterior to, the coronal plane of the garment, when the garment material is at rest, prior to being worn by the user, wherein the left sleeve portion and the right sleeve portion comprise; short sleeves terminating between an elbow and a biceps region; or long sleeves terminating between an elbow and a wrist, a lower torso portion having an aquatic sports performance garment material, the lower torso portion comprising; a waist region, a pelvic girdle region, including a crotch region; and a left leg portion and a right leg portion below the crotch region; wherein the left leg portion and the right leg portion comprise; a short leg portion terminating at or above a knee; or a long leg portion extending below the knee. In any one of the wetsuit configurations described herein, the wetsuit further comprises a neck region; a chest (pectoralis) region; an upper back (trapezius) region; an upper (latissimus dorsi) region, an abdominal region; a lateral oblique (oblique abdominal) region; and a mid-to-low back (thoraco-lumbar) region. In any one of the wetsuit configurations described herein, the garment material in the left shoulder region, left armpit region, right armpit region and right armpit region comprise a material thickness from about 0.5 mm to about 7.0 mm. In some embodiments of the wetsuit configurations described herein, the garment material in the left shoulder region, left armpit region, right armpit region and right armpit region comprise a material thickness from about 0.5 mm to about 2.5 mm. In any one of the wetsuit configurations described herein, the neck region, chest (pectoralis) region, and upper back (trapezius) region further comprise a material thickness from about 1.0 mm to about 7.0 mm. In some embodiments of the wetsuit configurations described herein, the neck region, the chest (pectoralis) region, or the upper back (trapezius) region further comprise a material thickness from about 1.0 mm to about 2.5 mm. In any one of the wetsuit configurations described herein, the free-floating flexible collar, the abdominal region, the lateral oblique (oblique abdominal) region or the mid-to-low back (thoraco-lumbar) region further comprise a material thickness from about 1.0 mm to about 7.0 mm. In some embodiments of the wetsuit configurations described herein, the free-floating flexible collar, the abdominal region, the lateral oblique (oblique abdominal) region or the mid-to-low back (thoraco-lumbar) region further comprise a material thickness from about 1.0 mm to about 3.0 mm. In any one of the wetsuit configurations described herein, the garment material in the left shoulder region, left armpit region, right armpit region and right armpit region comprise a modulus of elasticity from 0.31 kg/cm$^2$ at 50% elongation to 4.14 kg/cm$^2$ at 300% elongation.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An aquatic sports performance garment comprising:

an upper torso portion comprising:

a garment material comprising:

a left sleeve portion having a left shoulder region comprising a first neoprene panel structure having multi-directional elasticity having equal longitudinal, horizontal and diagonal stretch, a left armpit region comprising the first neoprene panel structure, and a left sleeve outer edge;

a right sleeve portion having a right shoulder region comprising the first neoprene panel structure having multi-directional elasticity having equal longitudinal, horizontal and diagonal stretch, a right armpit region comprising the first neoprene panel structure, and a right sleeve outer edge;

a chest region comprising a second neoprene panel structure providing multi-directional elasticity having varying ranges of elongation in two or more of the longitudinal, horizontal and diagonal direction; and an abdominal region comprising a third neoprene panel structure providing uni-directional elasticity having horizontal or vertical stretch;

wherein the left sleeve portion of the garment is biased in an arms-up configuration, such that the left sleeve outer edge extends out generally laterally relative to a sagittal plane of the garment from a left lateral aspect of the garment from about −15.0° to at least about +100.0° relative to a transverse plane transecting the upper torso at or about a top of the left shoulder region and a top of the right shoulder region, and wherein the left sleeve portion of the garment is further positioned approximately parallel to, or anterior to, a coronal plane of the garment, when the garment material is at rest, prior to being worn by the user, wherein the right sleeve portion of the garment is biased in an arms-up configuration, such that the right sleeve outer edge extends out generally laterally relative to the sagittal plane from a right lateral aspect of the garment from about −15.0° to at least about +100.0° relative to the transverse plane, and wherein the right sleeve portion of the garment is further positioned approximately parallel to, or anterior to, a coronal plane of the garment, when the garment material is at rest, prior to being worn by the user.

2. The aquatic sports performance garment of claim 1, wherein the first neoprene panel structure in the left shoulder region, left armpit region, right shoulder region and right armpit region comprises a material thickness from about 0.5 mm to about 2.5 mm.

3. The aquatic sports performance garment of claim 1, wherein the first neoprene panel structure in the left shoulder region, left armpit region, right shoulder region and right armpit region comprises a modulus of elasticity from 0.31 kg/cm2 at 50% elongation to 4.14 kg/cm2 at 300% elongation.

4. The aquatic sports performance garment of claim 1, wherein the upper torso portion further comprises:

a neck region comprising a single free-floating flexible collar comprising the first neoprene panel structure and a neck opening;

an upper back region; and an upper latissimus dorsi region comprising the second neoprene panel structure and, a lateral oblique region; and a mid-to-low back region comprising the third neoprene panel structure, wherein the neck region comprises a material thickness from about 0.5 mm to about 2.5 mm and a modulus of elasticity from 0.31 kg/cm2 at 50% elongation to 4.14 kg/cm2 at 300% elongation.

5. The aquatic sports performance garment of claim 4, wherein the upper back region and upper latissimus dorsi region further comprise a material thickness from about 1.0 mm to about 7.0 mm.

6. The aquatic sports performance garment of claim 4, wherein the lateral oblique region or the mid-to-low back region further comprise a material thickness from about 1.0 mm to about 7.0 mm.

7. The aquatic sports performance garment of claim 4, wherein the second neoprene panel structure and the third neoprene panel structure inhibit a direction of elongation of the garment material therein more than the first neoprene panel structure.

8. The aquatic sports performance garment of claim 1, wherein the left sleeve portion and the right sleeve portion comprise:

short sleeves terminating between an elbow and a biceps region; or long sleeves terminating between an elbow and a wrist.

9. The aquatic sports performance garment of claim 1, further comprising:

a lower torso portion having an aquatic sports performance garment material, the lower torso portion comprising:

a waist region;

a pelvic girdle region, including a crotch region; and a left leg portion and a right leg portion below the crotch region.

10. The aquatic sports performance garment of claim 4, wherein the first neoprene panel structure of the neck region, the left shoulder region, the left armpit region, the right shoulder region and the right armpit region comprises an elongation having a range from:

about 50% to about 400%;

about 100% to about 350%;

about 100% to about 300%;

about 100% to about 250%;

about 100% to about 200%; or about 100% to about 150%.

11. The aquatic sports performance garment of claim 10, wherein the left leg portion and the right leg portion comprise:

a short leg portion terminating at or above a knee; or long leg portion extending below the knee.

12. The aquatic sports performance garment claim 8, wherein the left sleeve portion and the right sleeve portion have material thicknesses in a range comprising:

about 0.5 mm to about 7.0 mm;

about 1.0 mm to about 6.0 mm;

about 1.0 mm to about 5.0 mm;

about 1.0 mm to about 4.0 mm;

about 1.0 mm to about 3.0 mm;

about 1.0 mm to about 2.0 mm;

about 0.5 mm to about 2.0 mm;

about 0.5 mm to about 1.5 mm;

about 1.0 mm to about 1.5 mm; or about 0.5 mm to about 1.0 mm.

13. The aquatic sports performance garment of claim 4, wherein in the upper back region the second neoprene panel structure ranges of elongation in two or more of the longitudinal, horizontal and diagonal directions are:

from about 50% to about 400%;

from about 100% to about 350%;

from about 100% to about 300%;

from about 100% to about 250%;

from about 100% to about 200%; or from about 100% to about 150%.

14. The aquatic sports performance garment of claim 4, wherein the ranges of elongation in either of the longitudinal or horizontal directions of the third neoprene panel structure of the abdominal region are:

from about 50% to about 400%;

from about 100% to about 350%;

from about 100% to about 300%;

from about 100% to about 250%;

from about 100% to about 200%; or from about 100% to about 150%.

15. The aquatic sports performance garment of claim 4, wherein in the upper latissimus dorsi region, the second neoprene panel structure ranges of elongation in two or more of the longitudinal, horizontal and diagonal directions are:

from about 50% to about 400%;

from about 100% to about 350%;

from about 100% to about 300%;

from about 100% to about 250%;

from about 100% to about 200%; or from about 100% to about 150%; and wherein in the chest region the second neoprene panel structure ranges of elongation in two or more of the longitudinal, horizontal and diagonal directions are:

from about 50% to about 400%;

from about 100% to about 350%;

from about 100% to about 300%;

from about 100% to about 250%;

from about 100% to about 200%; or from about 100% to about 150%.

16. The aquatic sports performance garment of claim 1, wherein the garment material further comprises:

a rubber;

a nylon;

a polyester;

a polypropylene; or spandex.

17. The aquatic sports performance garment of claim 1, further comprising a quick opening feature;

wherein the quick opening feature is positioned;

on an anterior aspect of the garment;

on a lateral aspect of the garment; or on a posterior aspect of the garment; and wherein the quick opening feature comprises:
a zipper;
a hook and loop attachment
a hook;
a loop;
a rail, or
a lip.

18. The aquatic sports performance garment of claim 4, wherein the ranges of elongation in either of the longitudinal or horizontal directions of the third neoprene panel structure of the lateral oblique region are:
from about 50% to about 400%;
from about 100% to about 350%;
from about 100% to about 300%;
from about 100% to about 250%;
from about 100% to about 200%; or
from about 100% to about 150%; and
wherein the ranges of elongation in either of the longitudinal or horizontal directions of the third neoprene panel structure of the mid-to-low back region are:
from about 50% to about 400%;
from about 100% to about 350%;
from about 100% to about 300%;
from about 100% to about 250%;
from about 100% to about 200%; or
from about 100% to about 150%.

19. A method of manufacturing an aquatic sports performance garment comprising:
providing garment material comprising a first neoprene panel structure having multi-directional elasticity having equal longitudinal, horizontal and diagonal stretch, a second neoprene panel structure having multi-directional elasticity having varying ranges of elongation in two or more of the longitudinal, horizontal and diagonal direction, and a third neoprene panel structure having uni-directional elasticity having horizontal or vertical stretch;
patterning an upper torso portion comprising;
a left sleeve portion having a left shoulder region, a left armpit region, and
a left sleeve outer edge comprising the first neoprene panel structure,
a right sleeve portion having a right shoulder region, a right armpit region, and a right sleeve outer edge comprising the first neoprene panel structure,
a neck region comprising a single free-floating flexible collar comprising the first neoprene panel structure;
a chest region, an upper back region, and an upper latissimus dorsi region comprising the second neoprene panel structure,
an abdominal region, a lateral oblique region, and a mid-to-low back region comprising the third neoprene panel structure; and
a quick opening feature;
wherein the neck region comprises a neck opening,
wherein the neoprene panel structures in the neck region, the left shoulder region, the left armpit region, the right shoulder region, and the right armpit region comprises material thicknesses from about 0.5 mm to about 2.5 mm,
wherein the left sleeve portion of the garment is biased in an arms-up configuration, such that the left sleeve outer edge extends out generally laterally relative to a sagittal plane of the garment from a left lateral aspect of the garment from about −15.0° to about +100.0° relative to a transverse plane transecting the upper torso at or about a top of the left shoulder region and a top of the right shoulder region, and wherein the left sleeve portion of the garment is further positioned approximately parallel to, or anterior to, a coronal plane of the garment, when the garment material is at rest, prior to being worn by a user,
wherein the right sleeve portion of the garment is biased in an arms-up configuration, such that the right sleeve outer edge extends out generally laterally relative to a sagittal plane of the garment from a right lateral aspect of the garment from about −15.0° to about +100.0° relative to the transverse plane, and wherein the right sleeve portion of the garment is further positioned approximately parallel to, or anterior to, a coronal plane of the garment, when the garment material is at rest, prior to being worn by the user,
wherein the single free-floating flexible collar is configured to seal around a neck of the user to reduce or prevent water from entering the garment through the neck opening.

20. A wetsuit comprising an aquatic garment material providing thermal insulation to a user thereof, the wetsuit comprising:
an upper torso portion comprising;
a left sleeve portion having a left shoulder region, a left armpit region and a left sleeve outer edge;
a right sleeve portion having a right shoulder region, a right armpit region and a right sleeve outer edge;
a neck region comprising a free-floating flexible collar with a neck opening;
a chest region;
an abdominal and a mid-back region;
a lower torso portion comprising;
a waist region;
a pelvic girdle region, including a crotch region; and
a left leg portion and a right leg portion below the crotch region;
wherein the aquatic garment material in the left shoulder region, the left armpit region, the right shoulder region, and the right armpit region comprises a first neoprene panel structure having a multi-directional liner having equal longitudinal, horizontal and diagonal stretch, multi-directional flexibility and having a material thickness from about 0.5 mm to about 2.5 mm;
wherein the chest region comprises a second neoprene panel structure providing multi-directional elasticity having varying ranges of elongation in two or more of the longitudinal, horizontal and diagonal direction,
wherein the abdominal and mid-back regions comprise a third neoprene panel structure providing uni-directional elasticity having horizontal stretch,
wherein the left sleeve portion of the garment is biased in an arms-up configuration, such that the left sleeve outer edge extends out generally laterally relative to a sagittal plane of the garment from a left lateral aspect of the garment at an angular range from about −15.0° to at least about +100.0° relative to a transverse plane transecting the upper torso at or about a top of the left shoulder region and a top of the right shoulder region, and wherein the left sleeve portion of the garment is further positioned approximately parallel to, or anterior to, a coronal plane of the garment, when the garment material is at rest, prior to being worn by the user;
wherein the right sleeve portion of the garment is biased in an arms-up configuration, such that the right sleeve outer edge extends out generally laterally relative to the sagittal plane from a right lateral aspect of the garment at an angular range from about −15.0° to at least about +100.0° relative to the transverse plane, and wherein the right sleeve portion of the garment is further positioned approximately parallel to, or anterior to, a coronal plane of the garment, when the garment material is at rest, prior to being worn by the user; and wherein the left sleeve portion and the right sleeve portion comprise either;

short sleeves terminating between an elbow and a biceps region; or long sleeves terminating between an elbow and a wrist;

wherein the left leg portion and the right leg portion comprise either;

a short leg portion terminating at or above a knee; or a long leg portion extending below the knee.

* * * * *